US010655440B2

(12) United States Patent
Darlington et al.

(10) Patent No.: US 10,655,440 B2
(45) Date of Patent: May 19, 2020

(54) EARPHONE TESTING

(71) Applicant: SOUNDCHIP SA, Aran-Villette (CH)

(72) Inventors: Paul Darlington, Aran-Villette (CH); Ben Skelton, Aran-Villette (CH)

(73) Assignee: SOUNDCHIP SA, Aran-Villette (CH)

( * ) Notice: Subject to any disclaimer, the term of this patent is extended or adjusted under 35 U.S.C. 154(b) by 0 days.

(21) Appl. No.: 16/094,167

(22) PCT Filed: Apr. 18, 2017

(86) PCT No.: PCT/GB2017/051067

§ 371 (c)(1),
(2) Date: Oct. 16, 2018

(87) PCT Pub. No.: WO2017/187136

PCT Pub. Date: Nov. 2, 2017

(65) Prior Publication Data

US 2019/0153830 A1 May 23, 2019

(30) Foreign Application Priority Data

Apr. 25, 2016 (GB) ..... 1607168.0

(51) Int. Cl.

| | |
|---|---|
| ***H04R 25/00*** | (2006.01) |
| ***H04R 29/00*** | (2006.01) |
| ***E21B 43/12*** | (2006.01) |
| ***H04R 1/10*** | (2006.01) |
| ***F04B 47/12*** | (2006.01) |
| ***F04B 53/12*** | (2006.01) |

(52) U.S. Cl.

CPC ..... *E21B 43/127* (2013.01); *F04B 47/12* (2013.01); *F04B 53/125* (2013.01); *H04R 1/1083* (2013.01); *H04R 29/00* (2013.01)

(58) Field of Classification Search

CPC ..... H04R 25/00; H04R 29/00; H04R 25/55; H04R 2225/49; H04R 2460/01

USPC ..... 381/60, 312, 314–315, 317–318

See application file for complete search history.

(56) References Cited

U.S. PATENT DOCUMENTS

| | | | | |
|---|---|---|---|---|
| 5,400,406 A * | 3/1995 | Heline, Jr. | ..... | G01R 27/02 381/58 |
| 6,232,785 B1 * | 5/2001 | Kelsey | ..... | G01R 31/02 324/511 |
| 10,045,128 B2 * | 8/2018 | Shennib | ..... | H04R 25/30 |

(Continued)

FOREIGN PATENT DOCUMENTS

| | | |
|---|---|---|
| CN | 103248766 A | 8/2013 |
| EP | 1865746 A2 | 12/2007 |
| EP | 2728906 A1 | 5/2014 |

OTHER PUBLICATIONS

International Search Report and Written Opinion in corresponding International Application No. PCT/US2017/051067, dated Jul. 21, 2017, 12 pages.

*Primary Examiner* — Suhan Ni

(74) *Attorney, Agent, or Firm* — Lempia Summerfield Katz LLC

(57) ABSTRACT

An earphone test system (20) includes a plurality of test stations (22) each operative to perform a function during testing of an earphone device (12) coupled thereto. During testing of earphone devices (12) coupled to the plurality of test stations (22) the earphone test system (20) is operative to expose each of the plurality of test stations (22) to a noise field generated by a common noise field source (29).

41 Claims, 19 Drawing Sheets

(56) References Cited

U.S. PATENT DOCUMENTS

| | | | | |
|---|---|---|---|---|
| 2014/0146973 | A1* | 5/2014 | Liu | H04R 29/00<br>381/58 |
| 2019/0037324 | A1* | 1/2019 | Darlington | H04R 1/08 |

* cited by examiner

EARPHONE TESTING

RELATED APPLICATION DATA

This U.S. national phase application is based on International Application No. PCT/GB2017/051067, filed on Apr. 18, 2017, which claimed priority to British Patent Application No. 1607168.0, filed on Apr. 25, 2016. Priority benefit of these earlier filed applications is hereby claimed.

DESCRIPTION

The present invention relates to an earphone test system and method of testing earphone devices particularly but not exclusively intended for testing earphone devices with Active Noise Reduction (ANR) functionality.

Earphones (e.g. circumaural or supra-aural earphones of the type connected together by a headband to form headphones or in-ear/in-the-canal earphones configured to be placed at the entrance to or in the auditory canal of a user's ear) are well known in the art. Active earphone systems incorporating an active earphone driver for providing advanced active features such as Active Noise Reduction (ANR) or binaural monitoring are also well known in the art. ANR techniques offer the capability to cancel (at least some useful portion of) unwanted external sound via feedforward control and/or unwanted sound sensed by an internal sensing microphone via feedback control. The development and manufacture of active headphones and earphones and, particularly, those systems that incorporate active noise reduction, require accurate measurement of the electro-acoustic response of the component parts of the system in representative operating conditions.

Conventional testing of active earphone systems is performed using equipment as illustrated in FIG. 1. FIG. 1 shows an earphone device under test 1 mounted on a headstand 2 (typically a Head and Torso Simulator ("HATS") or similar test fixture) which provides an appropriate electro-acoustic interface to the earphone device under test 1. The test is supervised by a test computer 3 which performs signal processing functions (the analysis of the test proper), hosts the definition of the test process in a series of 'scripts' or algorithmic representations (the 'test store'), accumulates test outcomes (in a 'results store') and presents or communicates results. The computer requires additional specialist electronics 4 to instrument the earphone device under test during the testing process and, specifically, to provide access to signals in the earphone device under test 1 via test interface 5 and to provide access 6 to transducers in the headstand 2. The additional electronics 4 provides signal generation, signal acquisition, signal conditioning (e.g. amplification and filtering) and control of the earphone device under test 1.

The conventional test strategy of FIG. 1 also provides for the system to be capable of generating test patterns to the earphone device under test 1, either to be applied electrically over interfaces 5 or 6 or acoustically via an array of external sound sources 7, which are under the control of the system.

The system of FIG. 1 is typically used in product development and not well adapted to be scaled for volume testing in a production test environment. Placement of the earphone device under test upon the test fixture takes time and should be undertaken with care in order that loading conditions are consistent and the measurement is accurate; the test must be performed by trained personnel. Further, the test system occupies considerable space, especially when it must be insonified by a carefully controlled external noise field in order to test feedforward noise control or other aspects of sound transmission over or through the headphone.

The present applicant has identified the opportunity for an improved form of testing system that permits rapid testing of earphone apparatus in a factory environment as part of the manufacturing process. In particular, the present applicant has devised a testing system with a new architecture, which is not a simple duplication of a multiplicity of instances of the system of FIG. 1. Rather, the new architecture takes novel approaches to the measurement task specifically with the goal of allowing rapid, large-scale measurement of active earphone systems.

In accordance with a first aspect of the present invention, there is provided an earphone test system comprising: a plurality of test stations each operative to perform a function during testing of an earphone device coupled thereto; wherein during testing of earphone devices coupled to the plurality of test stations the earphone test system is operative to expose each of the plurality of test stations to a noise field generated by a common noise field source.

In this way, an earphone test system suitable for use in a production line environment is provided in which noise field generation resources are shared between multiple test stations. Advantageously, such an arrangement allows the plurality of test stations to be provided in a common space (e.g. room or zone of a factory) allowing simplified access to the test stations when coupling/de-coupling earphone devices to and from the test stations to assist in high volume testing.

In one embodiment, the earphone test system is operative to allow earphone devices coupled to the plurality of test stations to be tested independently of one another. For example, each of the plurality of test stations may be independently instructed to commence a test procedure.

The earphone devices to be tested will typically comprise at least one electroacoustic driver and a processor module.

The earphone devices may take the form of headphones (e.g. a pair of earphone units (typically circumaural or supra-aural earphone units) connected together by a headband) or headbandless in-ear/in-the-canal earphone units configured to be placed at the entrance to or in the auditory canal of a user's ear and held in place by engagement with the user's ears. Typically, the earphone device is a multi-channel (e.g. stereo) device.

In one embodiment, each earphone device comprises at least one microphone and the processor module comprises an audio processing component operative to process signals received from the at least one microphone.

In one embodiment, each earphone device comprises at least one feedback microphone (e.g. for sensing pressure changes in a volume (e.g. sealed volume) between the driver of the earphone device and the auditory canal of a user's ear) and the audio processing component comprises a feedback Active Noise Reduction (ANR) function for processing signals received from the at least one feedback microphone.

In one embodiment, each earphone device comprises at least one feed-forward microphone positioned to sense external ambient acoustic noise and the audio processing component comprises a monitoring function (e.g. feedforward ANR function or binaural monitoring/talk through function) configured to provide an audio signal based on sound measurements obtained from the at least one feed-forward microphone.

In a first set of embodiments, the noise field source is configured to provide a localised noise field in a localised zone of the earphone test system and the earphone test system further comprises a transport mechanism for moving the plurality of test stations relative to the localised zone such that the plurality of test stations are exposed sequentially to the localised noise field. Typically the noise field source is fixed relative to the test area and the plurality of test stations move through the localised zone (e.g. in a continuous loop). However, in another embodiment the noise field could be configured to move relative to the test area (e.g. with the plurality of test stations being static).

In one embodiment, the earphone test system is configured to detect the position of the plurality of test stations at at least one point (e.g. at least one point in the continuous loop). For example, the earphone test system may detect when each of the plurality of test stations enters the localised zone (e.g. in order to trigger commencement of a test routine or part of a test routine requiring exposure to an external noise field).

In one embodiment, the localised zone comprises a first region in which a first phase of a test routine is performed and a second region provided in series with the first region and in which a second phase of a test routine is performed. The localised noise field generated in the first region may be the same or different to the localised noise field generated in the second region. In one embodiment, localised noise fields may be generated independently in the first and second regions (e.g. to allow activation at different times).

In one embodiment, the relative movement between the plurality of test stations and the localised zone is continuous (e.g. under constant speed).

In another embodiment, the relative movement between the plurality of test stations and the localised zone is non-continuous (e.g. stepwise). In this way, earphone devices under test may be positioned at known relative locations for fixed intervals of time as the test stations move relative to the localised zone.

In a second set of embodiment, the noise field generated by the noise field source is a dispersed uniform noise field and the plurality of test stations are arranged in a test array to allow exposure of the plurality of test stations to the noise field in parallel.

In one embodiment, the test array extends in at least two dimensions.

In a first embodiment, the noise field source comprises a distributed array of electro-acoustic drivers operative to generate a dispersed uniform noise field. For example, the distributed array of electro-acoustic drivers and the test array may be substantially planer and disposed substantially parallel to each other. In one embodiment, the distributed array of electro-acoustic drivers has a larger area than the test array (e.g. in order to minimise non-uniformity along edges of the test array).

In a second embodiment, the noise field source comprises a localised noise field source (e.g. substantially point source) and the plurality oftest stations are arranged around the localised noise field source (e.g. concentrically around the localised source). For example, the test array may be disposed on the surface of a notional sphere concentric with the localised noise field source.

In either of the first and second embodiments, an acoustic treatment may be disposed behind the test array to minimise reflections which might reduce uniformity of pressure in the dispersed uniform noise field generated at the test array.

In a third embodiment, the dispersed uniform noise field is generated by housing the noise field source and the plurality of test stations within a reverberant enclosure. Advantageously, this embodiment allows the plurality of test stations to be positioned at various distanced from the noise field source thereby simplifying the test array design and making the positioning of monitoring microphones/movement of users within the noise field less critical.

In one embodiment, the noise field (e.g. dispersed uniform noise field) generated by the noise field source during operation of the earphone test system is continuously generated. This may assist with the independent testing of earphone devices, particularly in the second set of embodiments where the coupling/de-coupling of earphone devices to test stations is typically not synchronised with any drive mechanism.

In another embodiment, the noise field source is activated/deactivated in dependence upon a test status of the plurality of test stations or (in the case of test stations configured to move relative to the noise field) position of the plurality of test stations.

In one embodiment, testing of the earphone devices involves a test routine comprising electrical and/or electro-acoustic testing.

In one embodiment, the test routine further comprises configuring the earphone device based on the results of the test routine.

In one embodiment, the plurality of test stations are configured to signal test results to a system operator (e.g. by means of a visual indicator).

In one embodiment, test system is operative to automatically sort tested earphone devices into pass/reject categories. In one embodiment, the test stations may comprise an automatic mechanism to allow tested earphone devices sorted into pass/reject categories to be released into an appropriate collection region (e.g. pass or fail collection region).

In one embodiment, the plurality of test stations is configured to allow mounting of earphone devices thereto by suspending the earphone devices from an electrical connection.

In one embodiment, wherein the plurality of test stations each comprise an orientating frame for mounting an earphone device to the test station in a predetermined orientation (e.g. predetermined orientation relative to the noise field generated by the noise field source).

In one embodiment, the plurality of test stations is configured to test earphone devices radiating into free-space.

In one embodiment, the plurality of test stations is configured to test earphone devices whilst fitted with a test seal (e.g. sealing cap or sealing grommet) configured to present a high radiation load during a test routine.

In one embodiment wherein the plurality of test stations each comprise a mounting fixture provided both to mount headphones and to provide a mating surface (e.g. sealing surface) configured to provide a high radiation load during a test routine.

In one embodiment, the mounting fixture includes: an ear simulator part defining a passageway leading to an external opening; and an eardrum microphone mounted in the passageway of the ear simulator part. In one embodiment, the mounting fixtures further comprise a head simulator part (e.g. HATS simulator part).

In one embodiment, the earphone test system further comprises at least one monitoring microphone (e.g. at least one array of monitoring microphones) operative to measure the noise field generated by the noise field source.

In one embodiment, the at least one microphone provides observations for a system designated to control or regulate the external noise.

In one embodiment, the uniformity of the noise field generated by the noise field source is monitored by the earphone test system using the at least one monitoring microphone (e.g. by means of at least one array of monitoring microphones distributed along the test array) and adjusted to maintain a predetermined level of uniformity.

In one embodiment, the spectral density of the noise field is monitored by the earphone test system using the at least one monitoring microphone.

In one embodiment, each of the plurality of test stations is operative to communicate with the earphone device to be tested via an interface (e.g. two-way interface) to allow data transmission between the earphone device and the test station during a test/configuration procedure.

Typically, one of each test station/earphone device pairing will include a test module for performing (e.g. rapid) automated testing of the earphone device when mounted on/connected to the test station. Typically, each test module is configured to measure a response of the earphone device to a test pattern reproduced by the noise field source. In one embodiment, each test module is further configured to measure a response of the earphone device to a test pattern reproduced by an electro-acoustic driver of the earphone device.

Each test module may perform one or more of the following the analysing steps: a receiver response check; a receiver polarity check; a plant response check; a plant phase check; a plant fitting check; a gain adjust limit check; a feedback ANR check; an EQ response check; and a balance test.

In one embodiment, each test module is operative to make estimates of electrical and/or electroacoustic transfer functions of the earphone device under test by comparing signals within the earphone device under test.

In one embodiment, each test module is operative to make estimates of electrical and/or electroacoustic transfer functions of the earphone device by comparing a first signal within the earphone device and a second signal external to the earphone device.

In one embodiment, each test module is capable of computing configuration settings for the earphone device under test based on the estimated electrical and/or electroacoustic measurements and/or transfer functions.

In one embodiment, each test module is operative to transmit audio signals to at least one driver of the earphone device/test station pairing and receive measurement signals from at least one microphone of the earphone device/test station pairing (e.g. eardrum microphone of the test station). Typically, each test module is configured to provide a multi-channel output and receive a multi-channel set of responses.

In one embodiment, each test module is configured to store and process received measurements.

In one embodiment, each test module is configured to generate/store one or more pre-generated test pattern operative to produce an input signal to drive the electroacoustic driver of the earphone device.

In one embodiment, each test module is provided as part of the test station and the earphone devices each comprise a test pattern generator configured to generate one or more pre-generated test pattern operative to produce an input signal to drive the electroacoustic driver of the earphone device. In this way, considerable bandwidth/time may be saved since there is no need to transmit the test pattern from the test station to the earphone device during testing.

In one embodiment, the test pattern generator operates according to a deterministic rule known to each test station. For example, the test pattern generator may operate according to a pseudo-random sequence with the method and seed of the pseudo-random sequence being known to each earphone device/test station pairing.

In one embodiment, each test module is connected to a computer network (e.g. local network or extended network).

In one embodiment, each test module is configured to follow a test routine defined by a test routine source component on the computer network.

In one embodiment, the earphone test system is configured to accumulate test results in a central location.

In this way the testing may be observed, controlled and updated centrally (and transparently), ensuring the integrity and security of the testing process.

In one embodiment, the earphone test system further comprises a link to at least one further test module operative to test components or sub-systems from which the earphone devices are assembled. For example, the earphone test system may comprise a link to at least one component-level test module for testing components (e.g. transducers or passive acoustic components) used to assemble the earphone devices or may comprise a link to at least one sub-assembly test module for testing sub-assembly parts (e.g. PCBAs or other completed electronic assemblies) used to assemble the earphone devices. In this way, testing performed at the out-going quality control stage may benefit from information collected during production on the testing of component parts and sub-assemblies which have been used in the assembly of that individual earphone device.

In accordance with a second aspect of the present invention, there is provided a method of testing earphone devices during a production line manufacturing process comprising: providing an earphone test system as defined in the first aspect of the invention (e.g. as defined in any embodiment of the first aspect of the invention); for a first group of earphone devices to be tested: 1) coupling the earphone devices with available ones of the plurality of test stations; 2) exposing the plurality of test stations to the noise field generated by the common noise field source; 3) for each earphone device activating a test routine for testing the earphone device such that at least a phase of the test routine is conducted whilst the test station to which the earphone device is coupled is exposed to the noise field; 4) de-coupling each earphone device from its respective one of the plurality of test stations following completion of at least the phase of the test routine on the earphone device; and repeating steps 1)-4) for a second group of earphone devices to be tested.

In one embodiment the step of coupling the step of coupling the second group of earphone devices to the plurality of test stations is commenced before the step of de-coupling the first group of earphone devices from the plurality of test stations is completed. In this way a continuous process of testing may be achieved.

In one embodiment, the step of activating a test routine is carried out independently for each earphone device.

Embodiments of the present invention will now be described by way of example with reference to the accompanying drawings in which.

Figure 2:
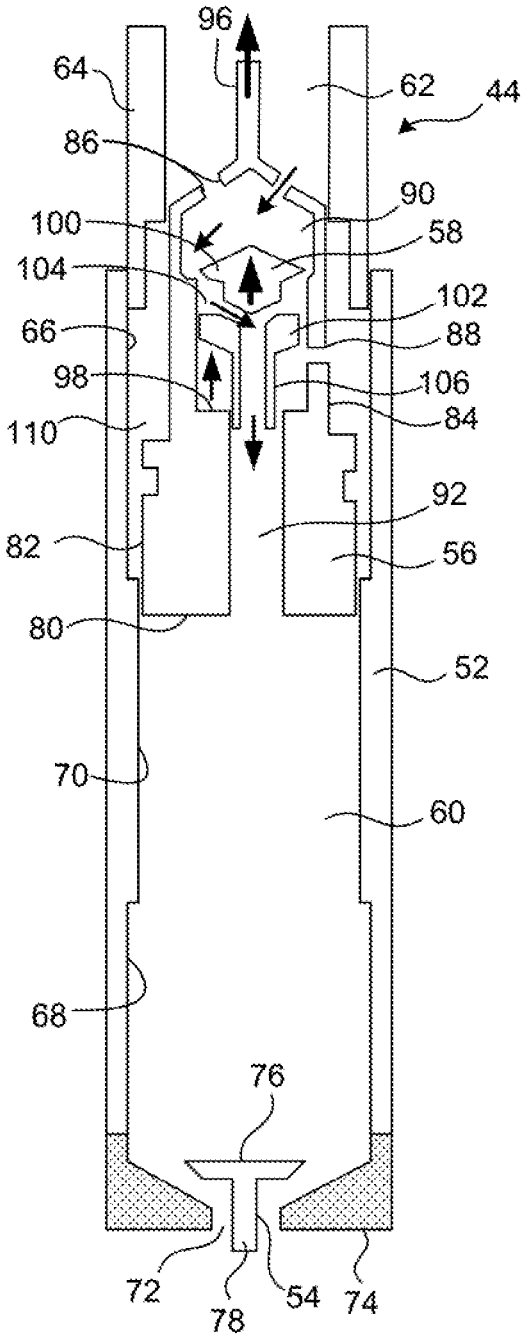
FIG. 2 is schematic overview of an earphone test system in accordance with the present invention.
Figure 3:
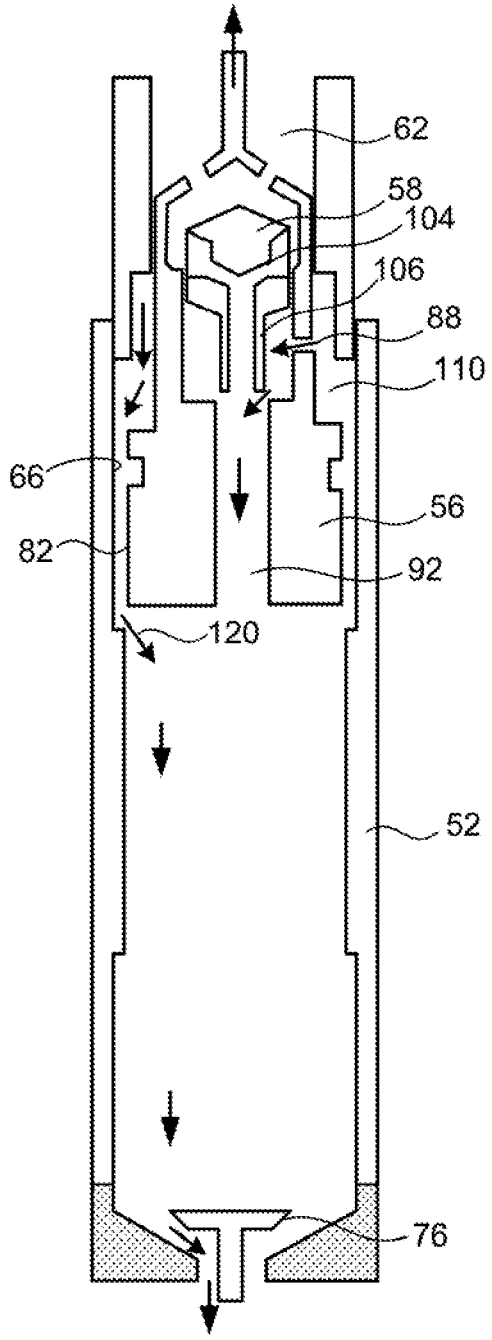
FIG. 3A is a schematic view of a first embodiment of an earphone test assembly suitable for use in the system of FIG. 2 illustrated testing in-ear earphones.
FIG. 3B is a schematic view of the in-ear earphones illustrated in FIG. 3A showing a technique for sealing the in-ear earphones during testing.
FIG. 3C is a schematic view of the earphone test assembly of FIG. 3A illustrated in use testing headphones.
Figure 6:
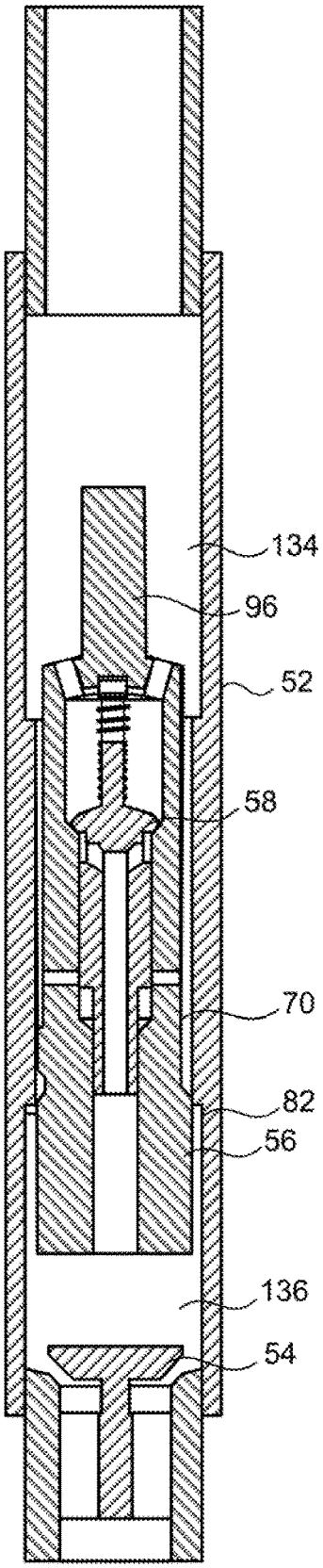
Figure 7:
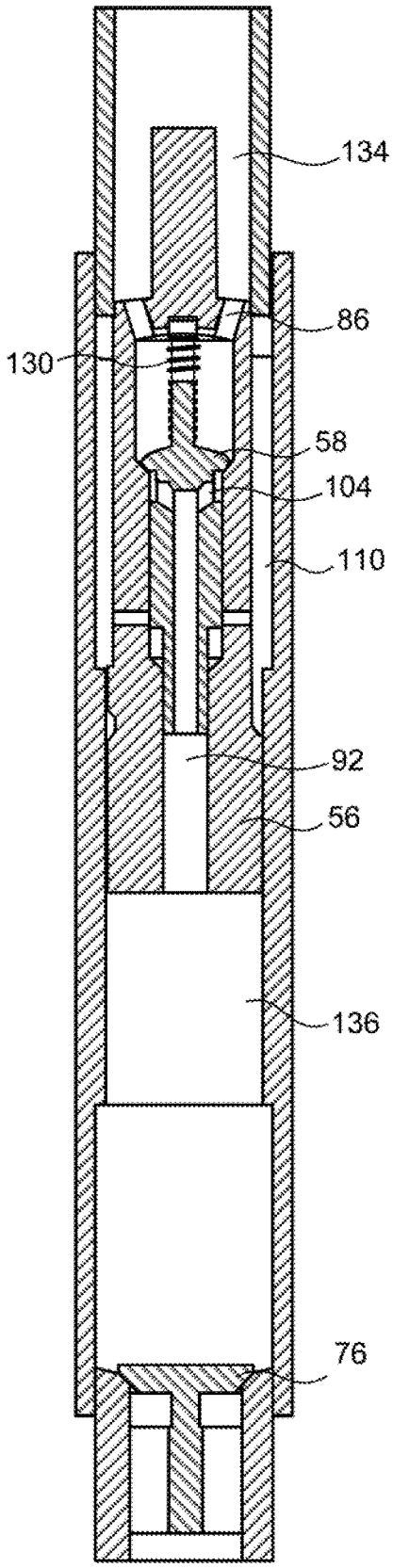
Figure 8:
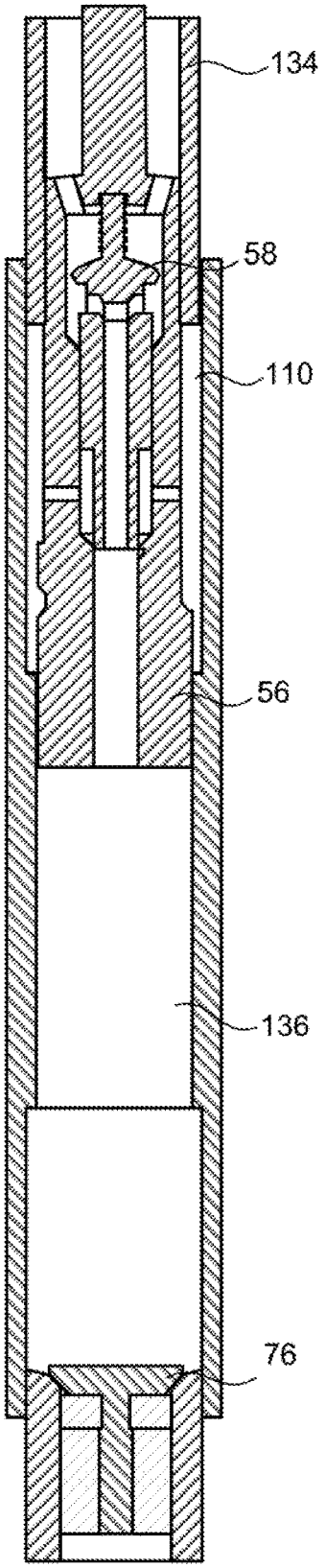
Figure 9:
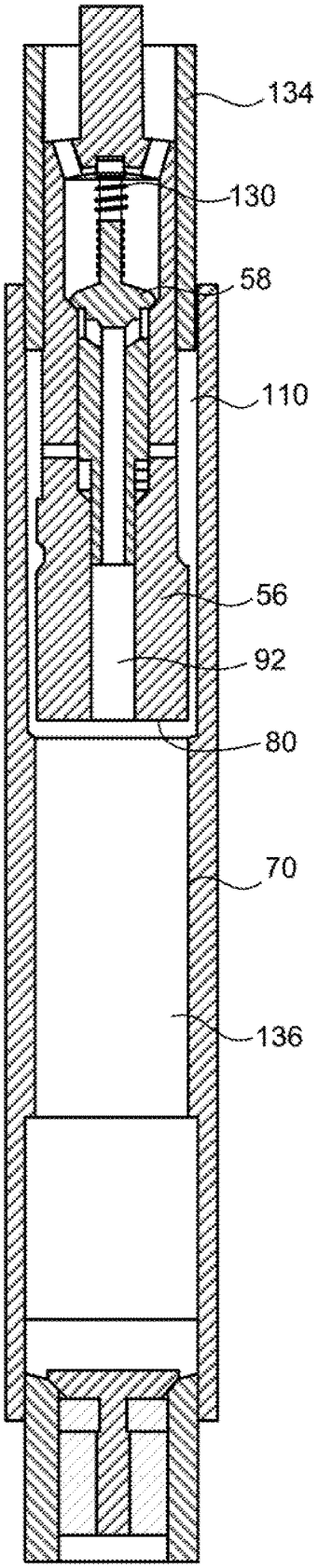
Figure 11:
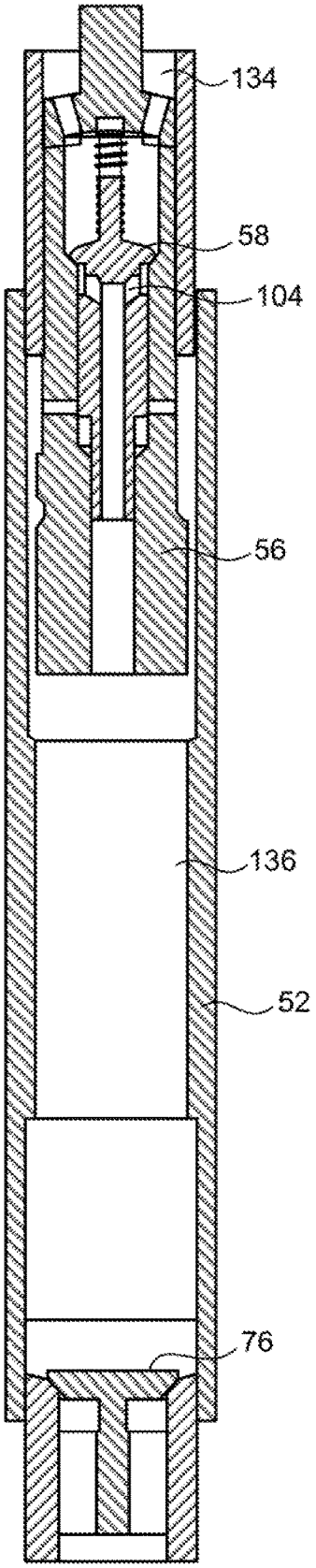
Figure 12:
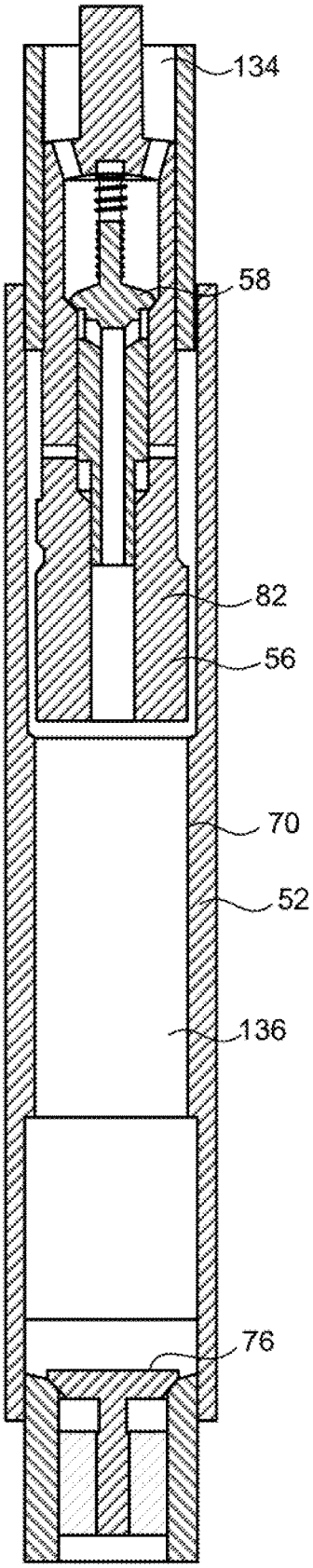
Figure 13:
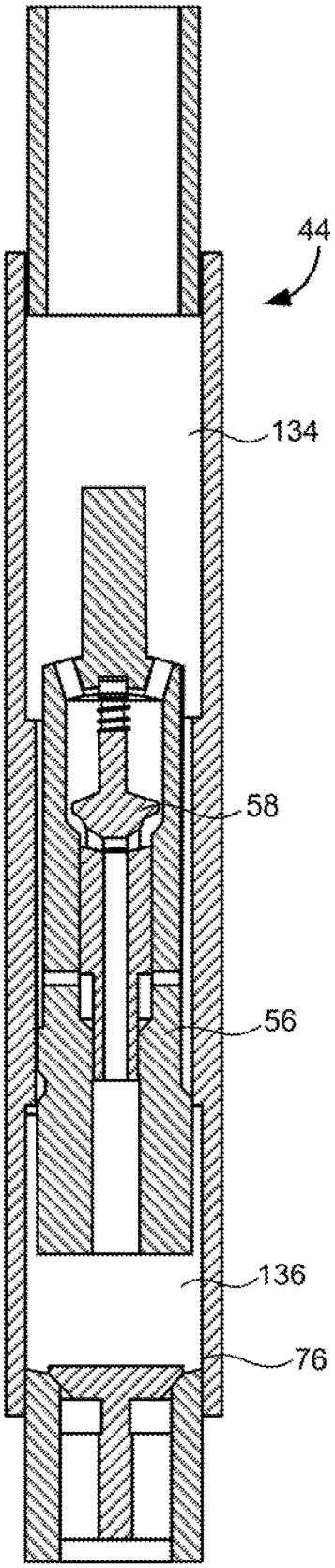
Figure 14:
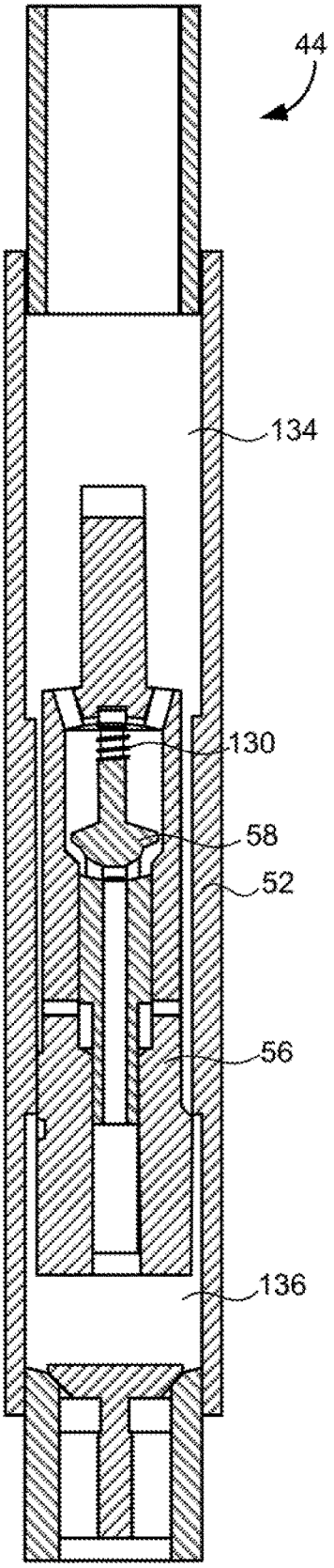
Figure 15:
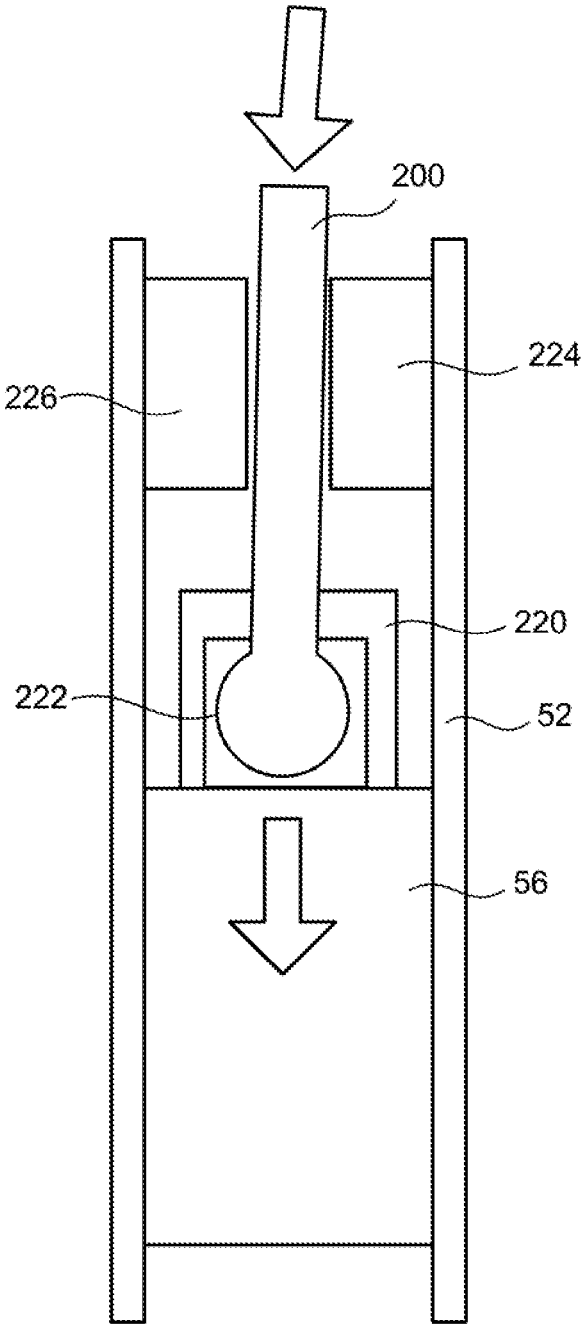
Figure 16A:
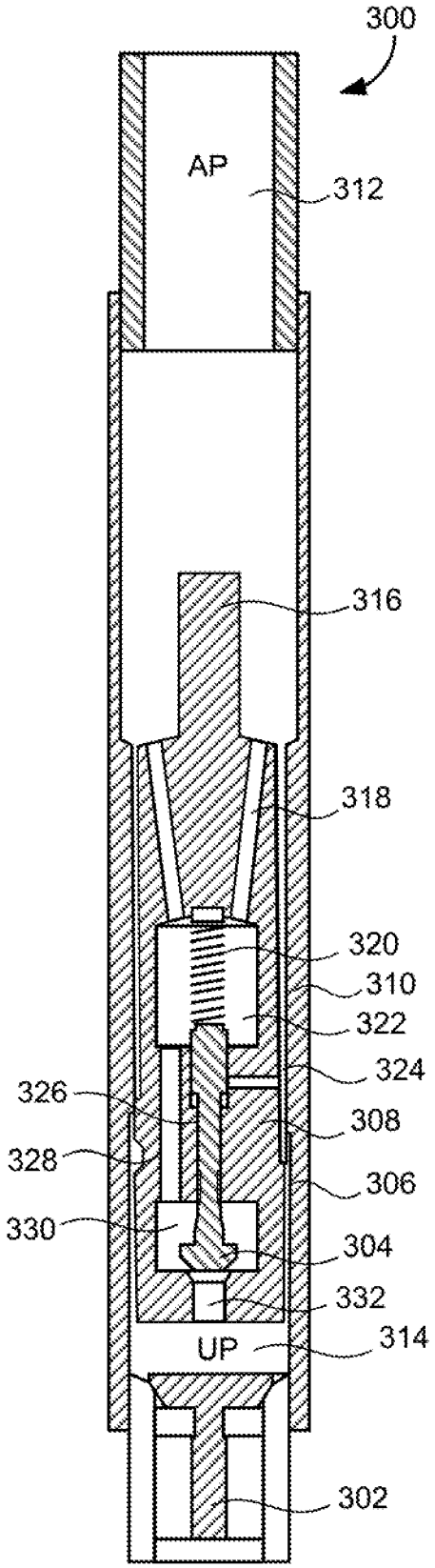
Figure 16B:
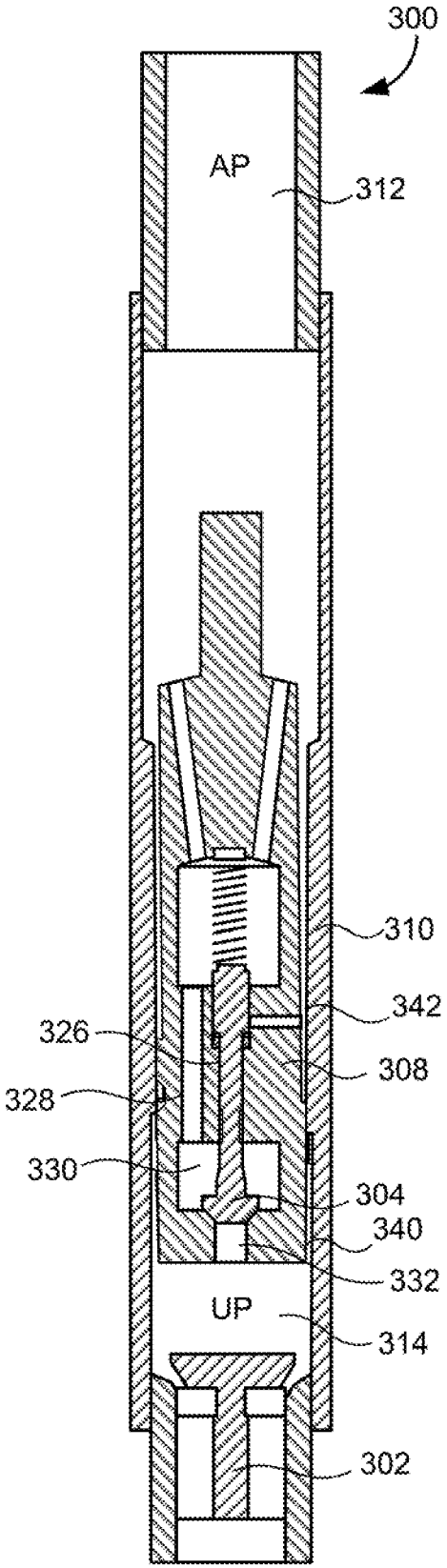
Figure 16C:
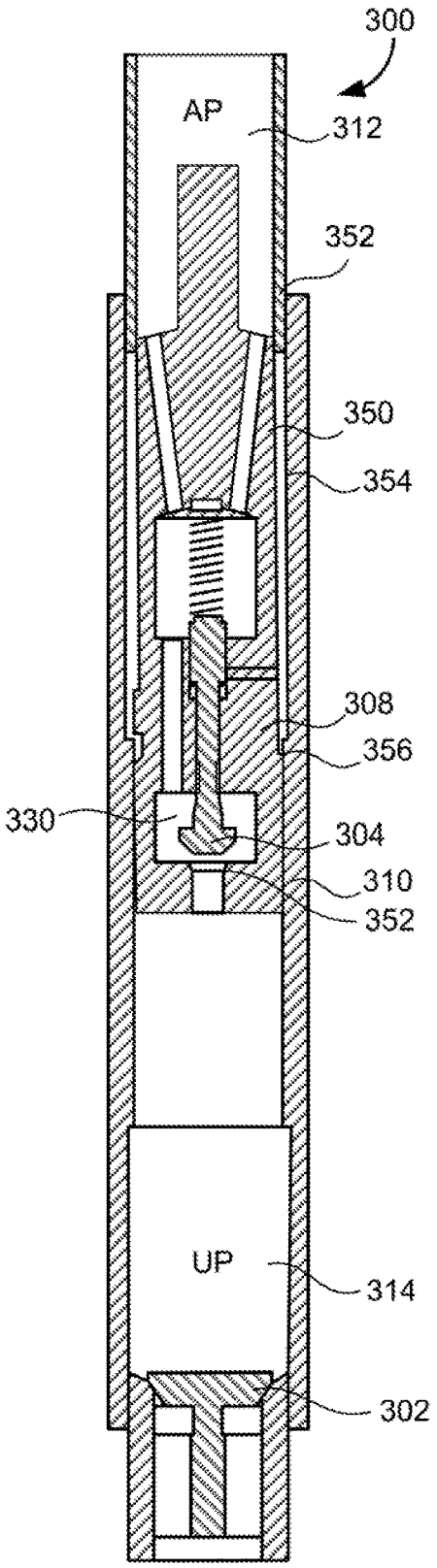
Figure 16D:
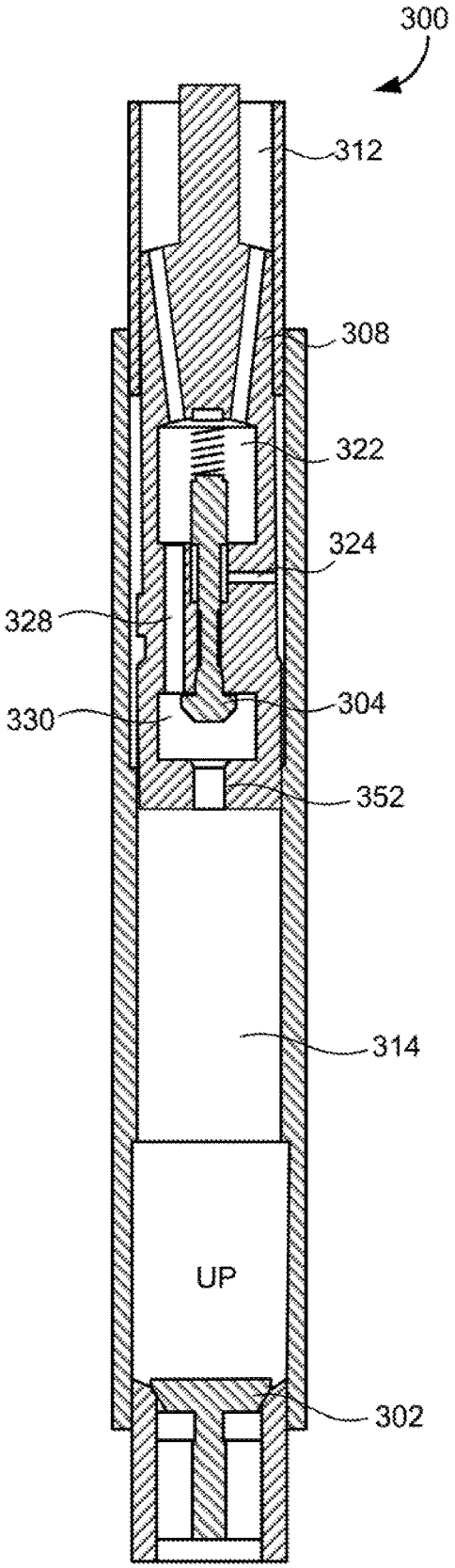
Figure 16E:
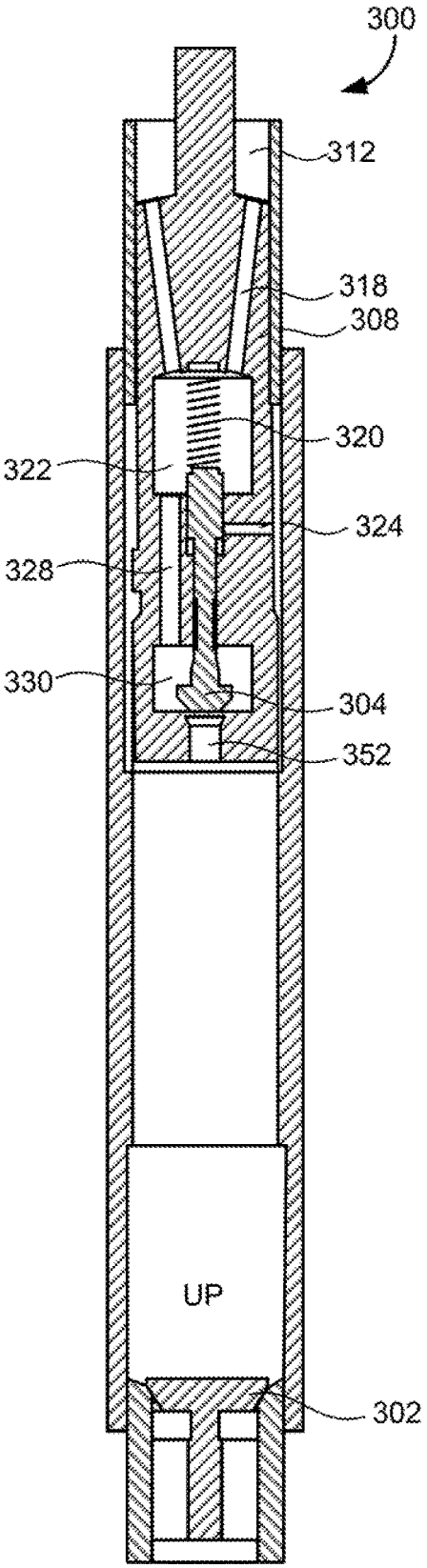
Figure 16F:
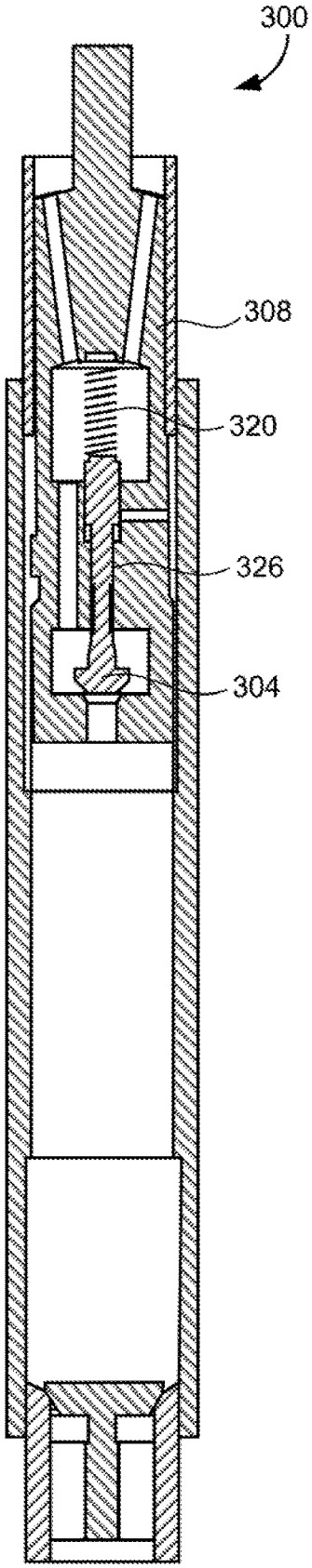
Figure 16G:
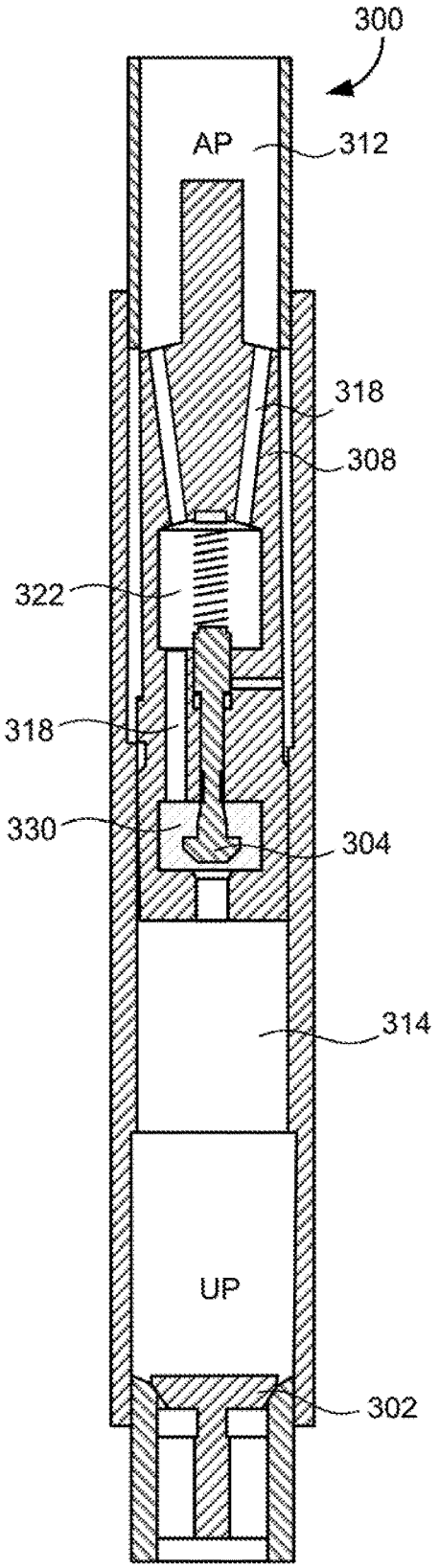
Figure 16H:
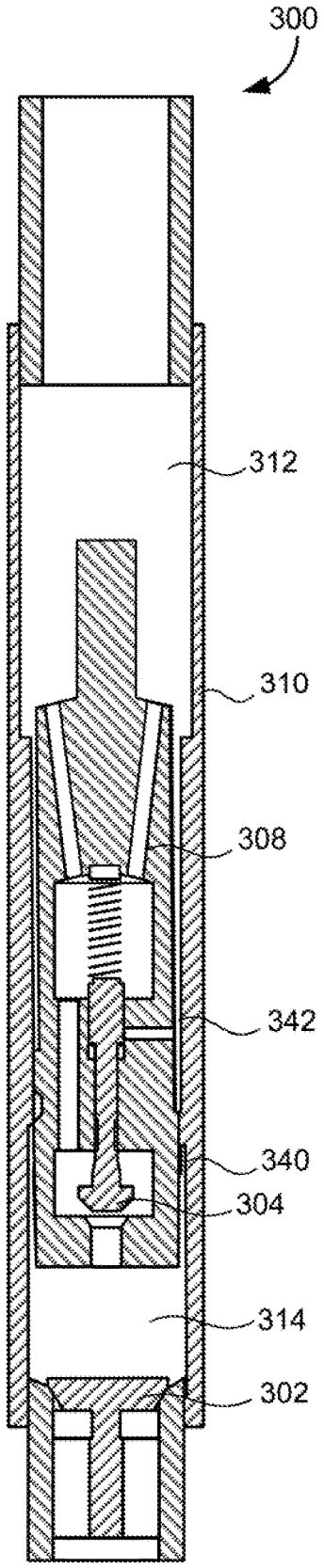
Figure 16I:
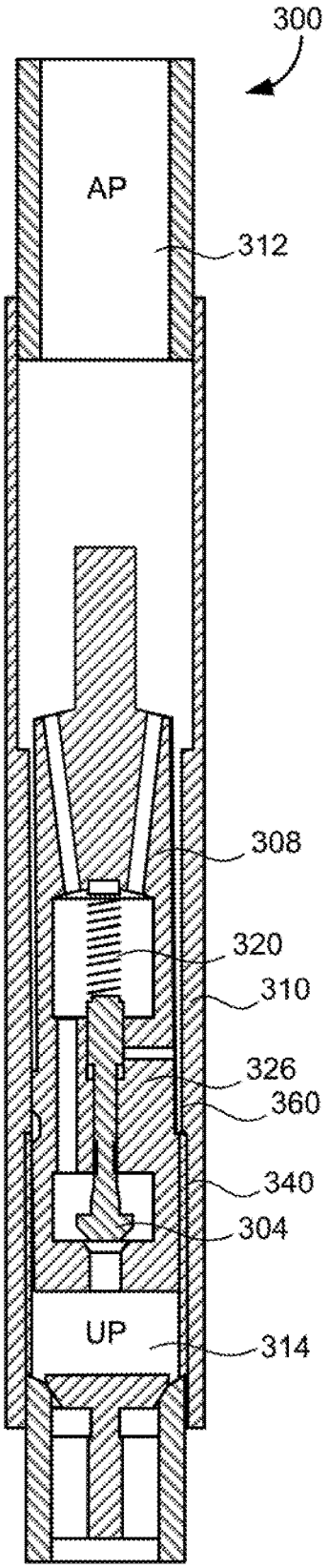
Figure 17A:
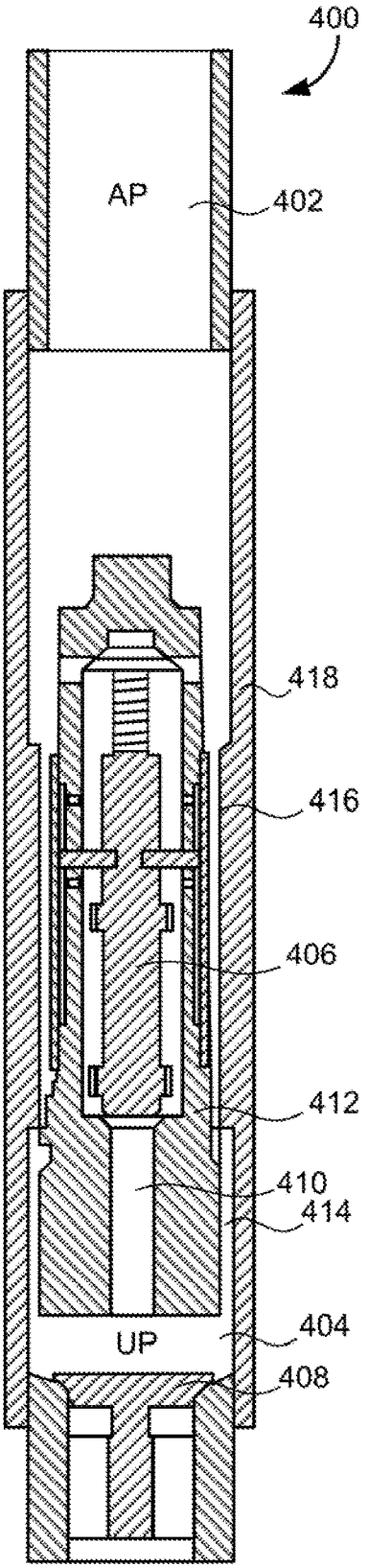
Figure 17B:
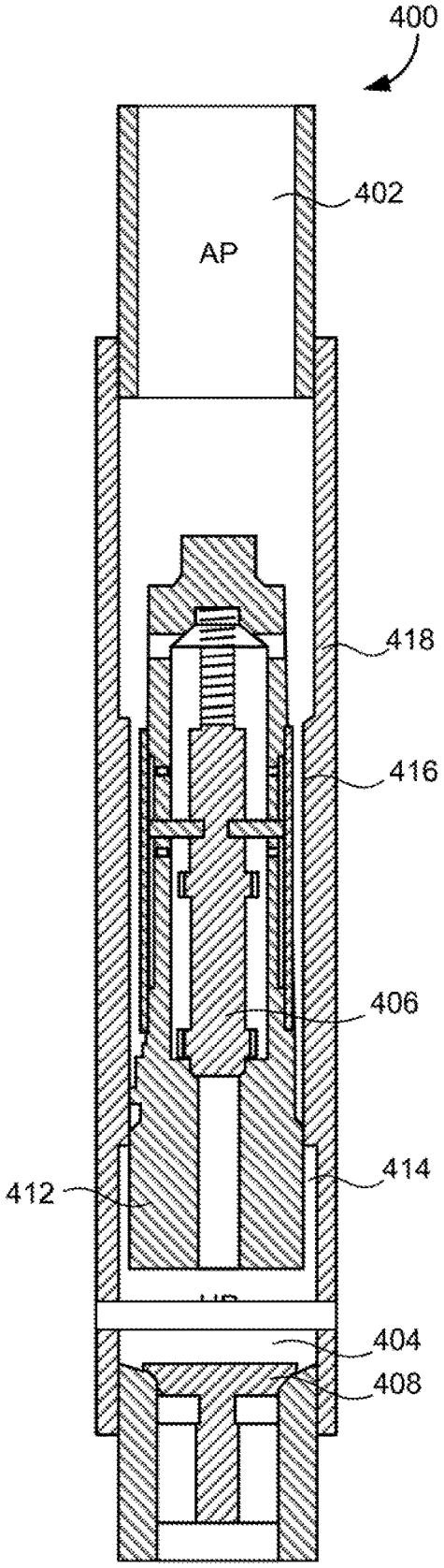
Figure 17C:
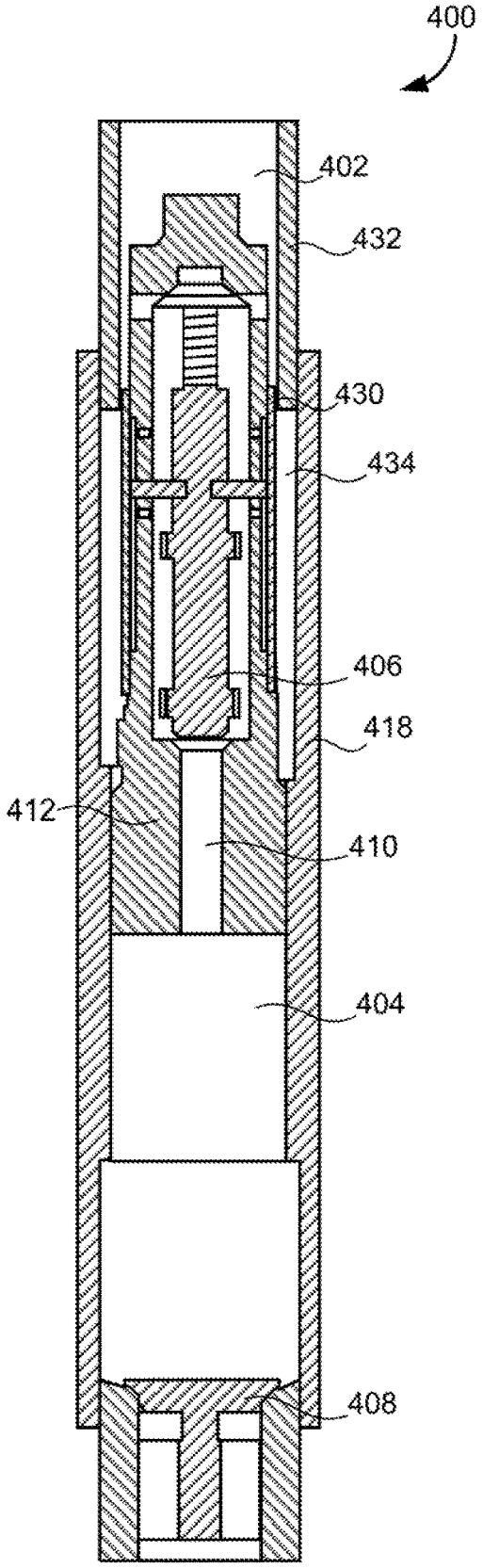
Figure 17D:
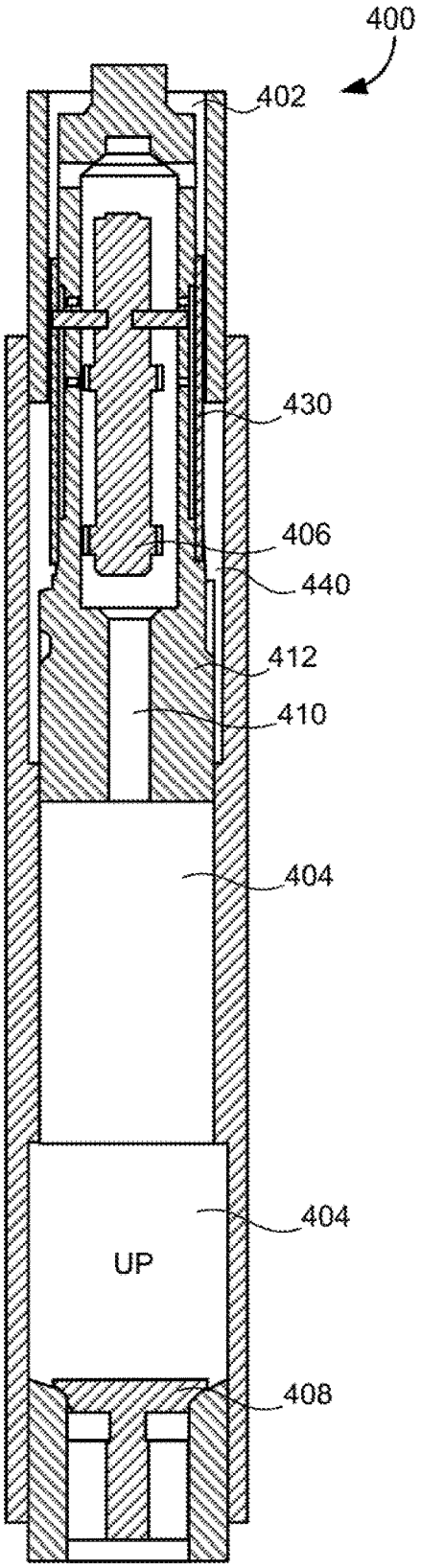
Figure 17E:
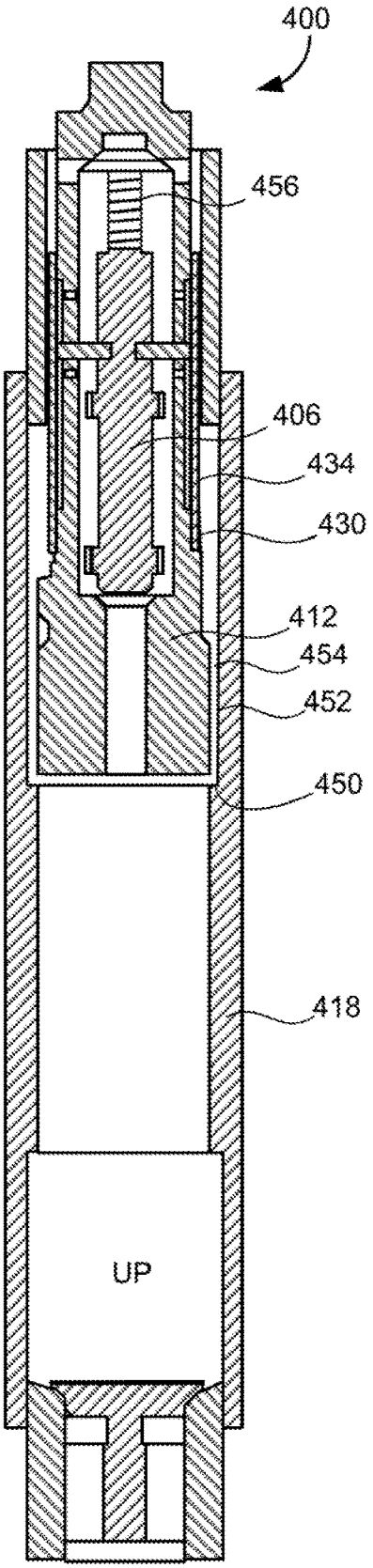
Figure 17F:
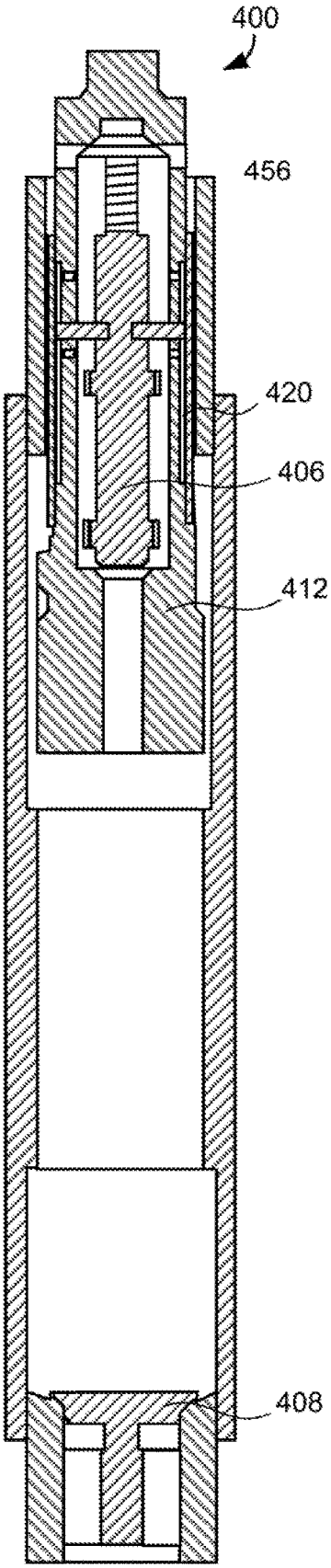
Figure 17G:
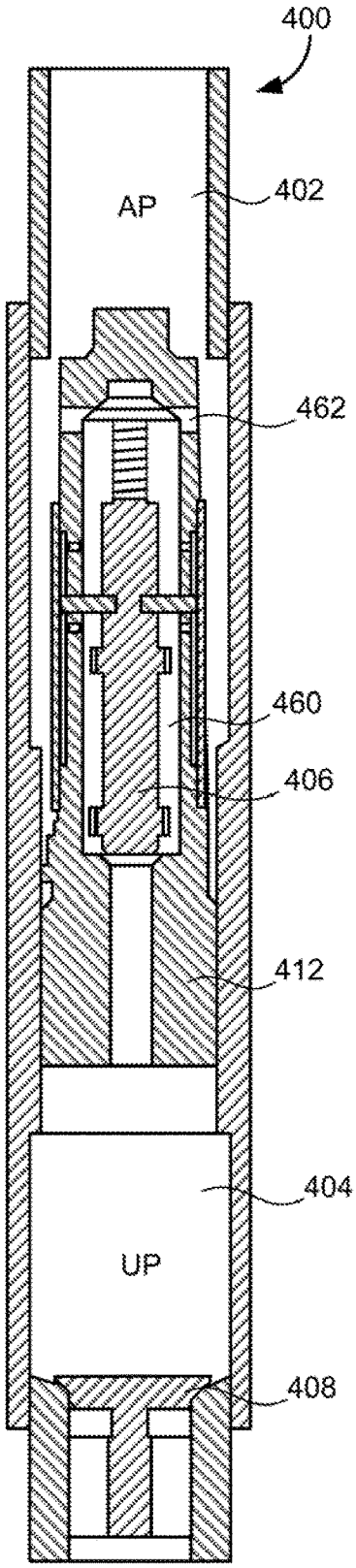
Figure 17H:
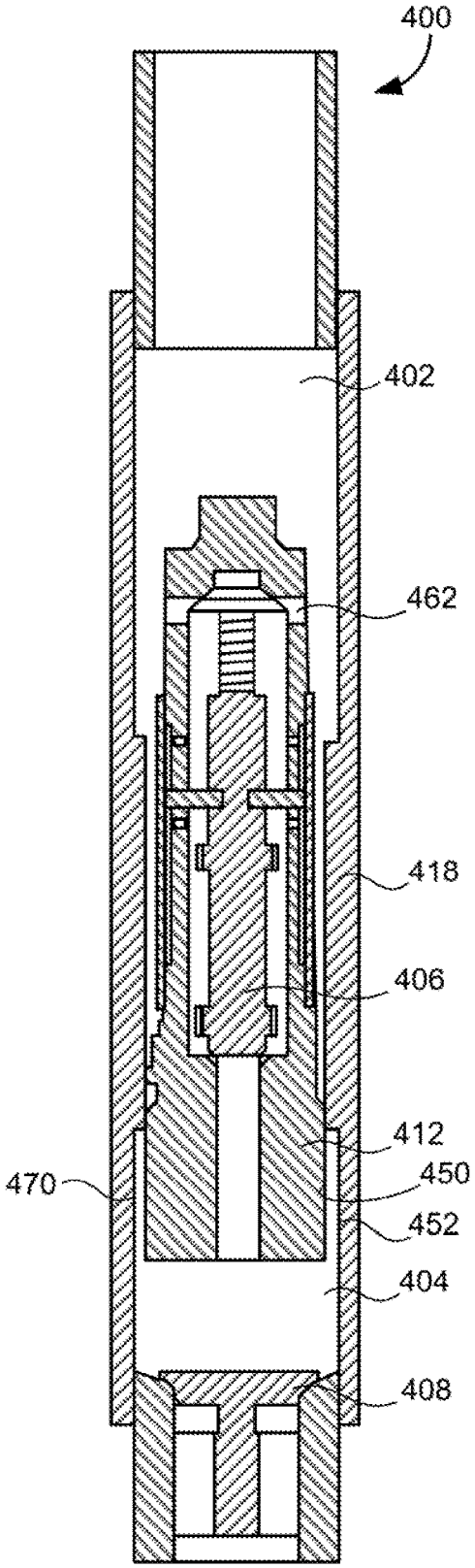
Figure 17I:
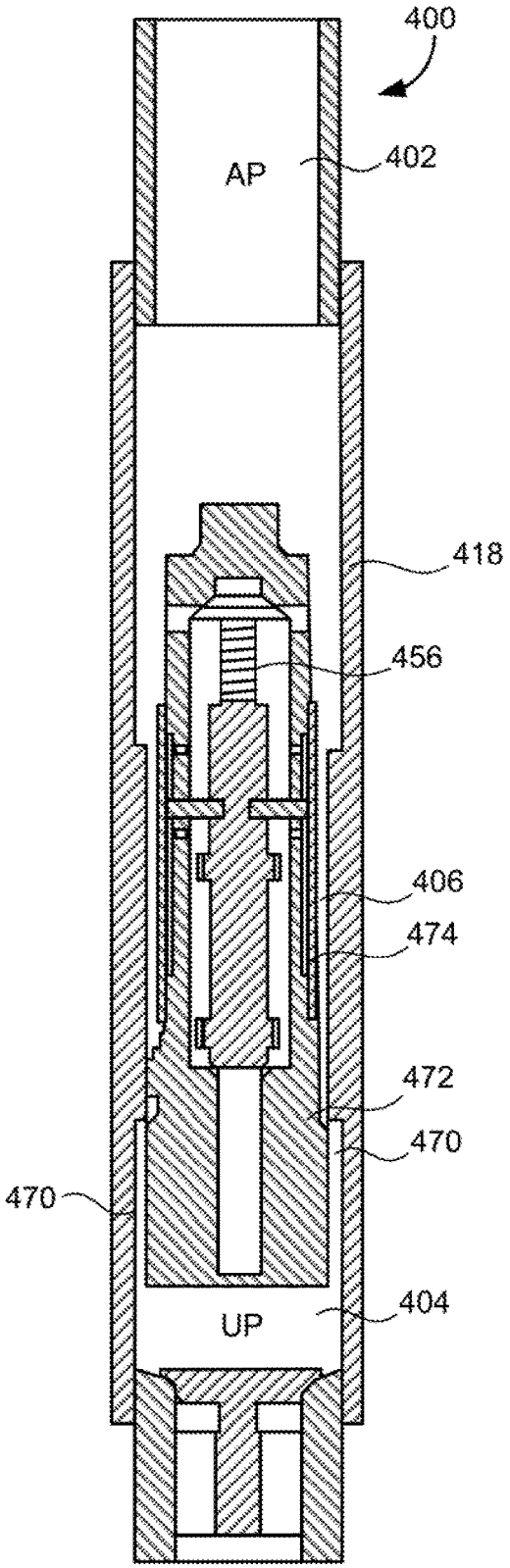
Figure 18A:
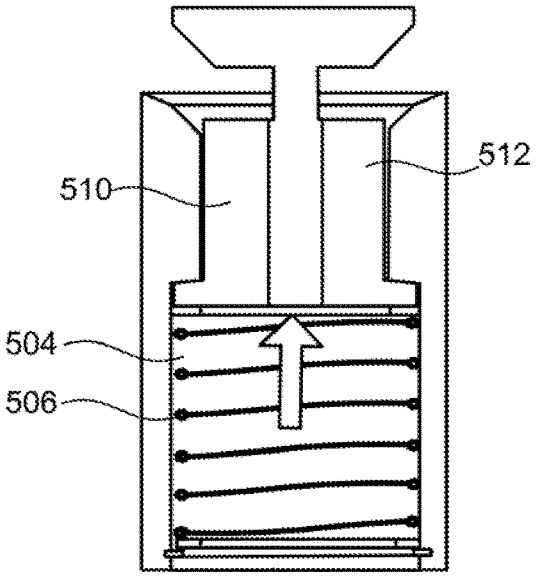
Figure 18B:
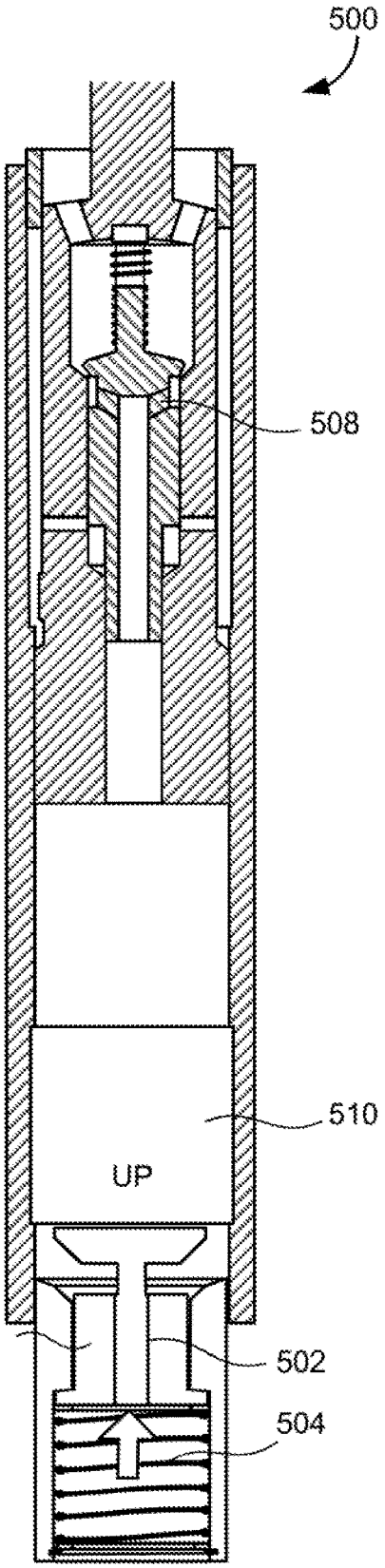

FIGS. 6A-C are schematic views showing operation of the earphone test assembly of FIG. 3;

FIG. 7 is a schematic view of a fourth embodiment of an earphone test assembly suitable for use in the system of FIG. 2;

FIG. 8 is a schematic view of a further embodiment of an earphone assembly suitable for using the system of FIG. 2;

FIG. 9 is a schematic view of a yet further embodiment of an earphone test assembly suitable for using the system of FIG. 2;

FIG. 10A is a schematic view of a first array set-up for use in the earphone test assembly of FIG. 9;

FIG. 10B is a schematic view of a second array set-up for use in the earphone test assembly of FIG. 9;

FIG. 10C is a schematic view of a third array set-up for use in the earphone test assembly of FIG. 9;

FIGS. 11A-C show a schematic overview of an underlying network infrastructure for implementing the earphone test system of FIG. 2; and FIG. 12 shows an example of data exchange between a test station and an earphone device under test during operation of the earphone test system of FIG. 2.

FIG. 2 shows an earphone test system 10 comprising an earphone test assembly 20 comprising a plurality of test stations 22 for coupling earphones under test 12 and a common noise generator 24 driving an array of loudspeakers 29. Each test assembly 20 comprises a test module 22A operative to follow a test process defined on a separate test routine source component 150, which allows the test process to be undergone by all earphone devices under test 12 to be modified centrally. Similarly, the results are accumulated in a central location 160. Local operation of the test system 10 can be monitored at an operator interface 170 and a communication path 180 allows both data from the system to be distributed globally and the system to be controlled remotely.

Figure 1:
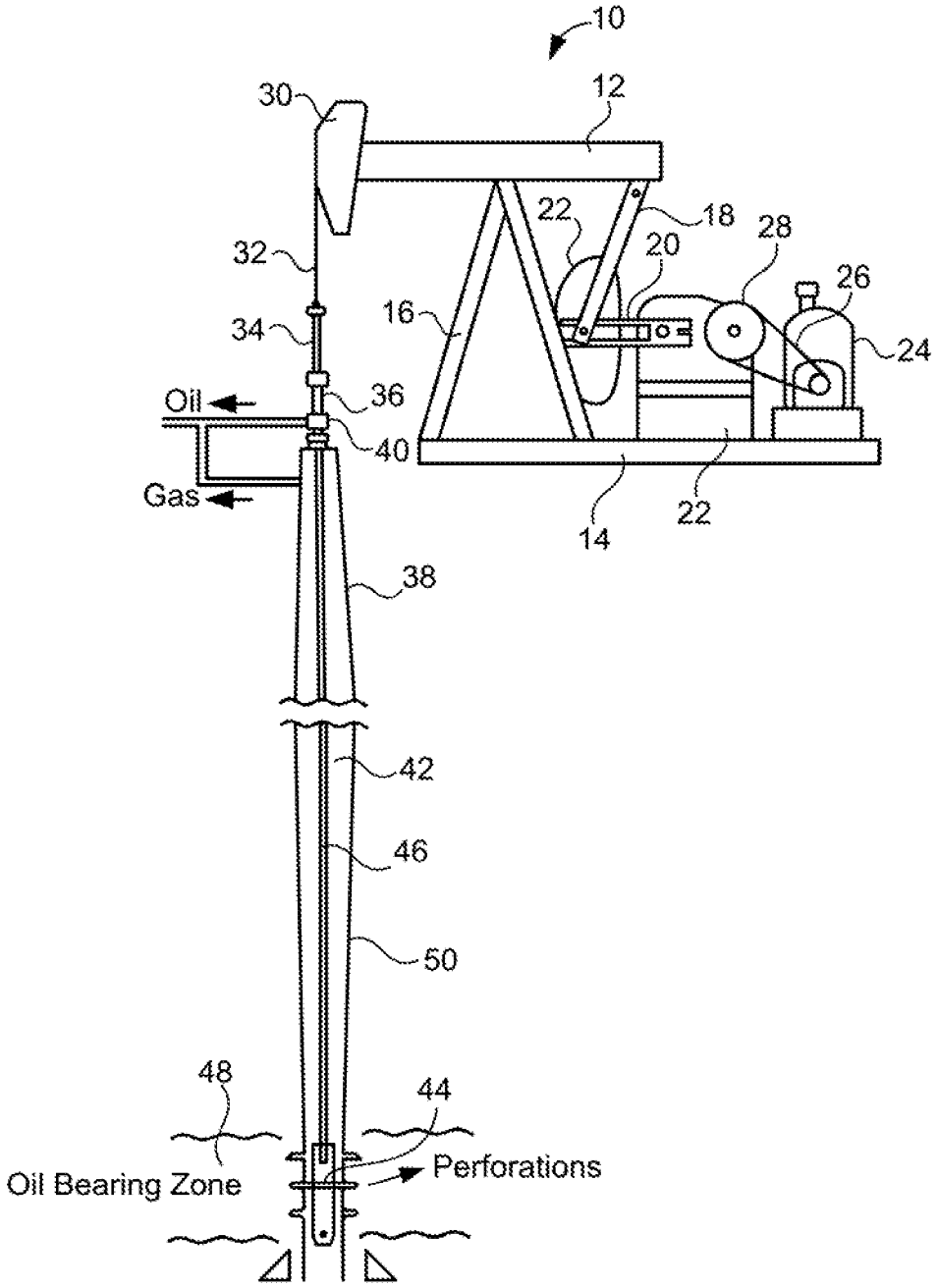
FIG. 1 PRIOR ART
FIG. 1 is a schematic illustration of a prior art earphone testing system.

It should be noted that test stations 22 are not simply repeated instances of the system of FIG. 1. Rather, they implement only the interface to the earphone device under test (via a simplified interface), a test routine and may optionally provide a simplified headstand or mounting means. Furthermore, all of test stations 22 operate autonomously. Any requirement for excitation from an external noise field is provided by (e.g. continuously acting) external noise generator 24 driving a loudspeaker array 29 which services all test stations.

Earphone test system 10 benefits from the ability to link to a group of further test modules 100 which are used to test elements from which the earphone devices under test 12 are assembled. The group of further modules 100 may include component-level test systems for the transducers in the earphones under test 12, including multiple instances of speaker test modules 110 and microphone test modules 120 and for critical passive acoustic components, such as multiple instances of earpad test modules 130. Earphone test system 10 may further benefits from the ability to link to modules which are used to test sub-systems from which the earphones under test are assembled, including multiple instances of assembly test modules 140 for testing PCBAs or other completed electronic assemblies. By these means, the testing performed at out-going quality control on a completed earphone device under test 15 may benefit from information aggregated during production on the testing of the component parts and sub-assemblies which have been used in the assembly of that individual sample (as all components and sub-assemblies are traceable). This level of traceability delivers additional benefit in the provision of diagnostic information, particularly in the event of a No-go result, where a unit has to be re-worked.

The distribution of the test functionality, 'test store' (150), 'results store' (160) and 'results presentation' (170) resources from the test computer 3 of the 'single' test system of FIG. 1 and the 'signal acquisition', 'signal generation', 'signal conditioning' and 'headphone control' resources from the headstand 2 of test system of FIG. 1 into the new, networked architecture for high-volume testing of FIG. 2, yields benefits in speed, such that the testing strategy can be extended to production volumes which would be economically unfeasible using simply repeated instances of the traditional testing method.

Figure 10:
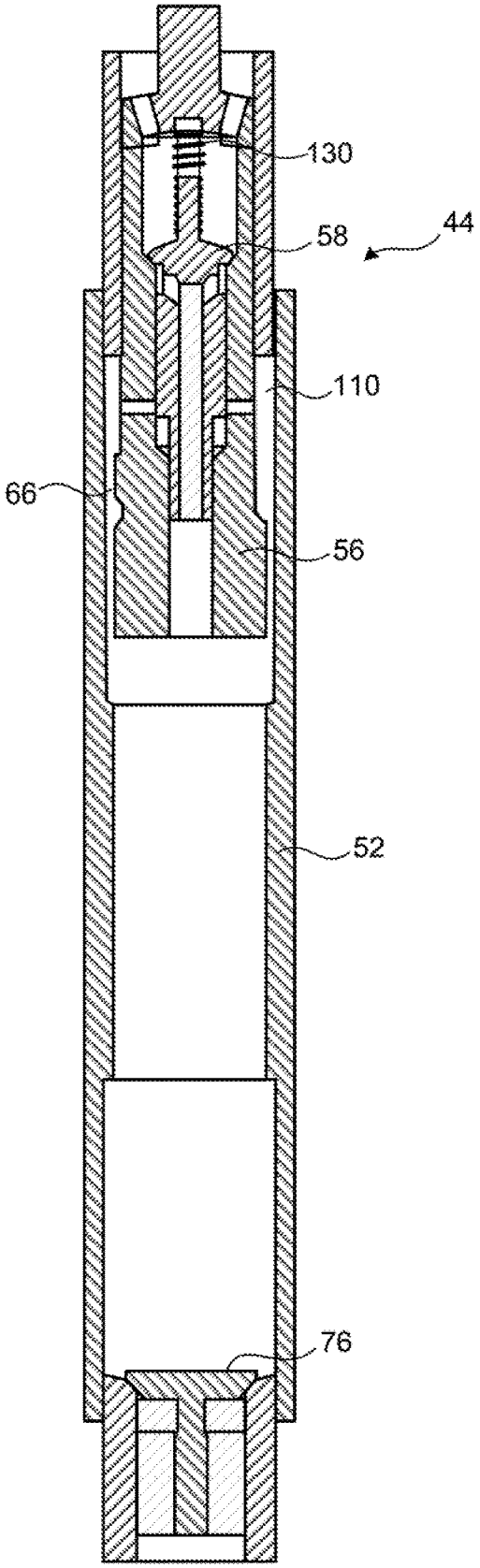

The structure and functionality of earphone test assembly 20 will now be discussed with reference to FIGS. 3-11 which fall into two distinct groups of embodiments: 1) the embodiments of FIGS. 3-9 in which test stations 22 are exposed sequentially by means of a transport mechanism to a localised noise field generated by noise generator 24 via loudspeaker array 29; and 2) the embodiments of FIGS. 10-11 in which test stations 22 are exposed in parallel to a dispersed uniform noise field generated by noise generator 24 via loudspeaker array 29. For the sake of simplicity FIGS. 3-9 illustrate the concept of a transport mechanism using a continuous overhead belt arrangement. However, it will be understood that there are a number of equivalent methods by which the required relative movement between the test stations and localised noise field may be achieved. All of these options will be self-evident to those familiar with the 'transport' technologies of process engineering and will not be rehearsed in the present description.

With reference to FIG. 3A, an earphone test assembly 20 is shown comprising a transport mechanism 30 comprising a continuous overhead belt 31 running between two pulleys 32 which rotate to impart a fixed linear motion to the belt 31. Equally disposed along the length of the belt 31 are a number of identical autonomous electronic test stations 22 as previously described each of which is capable of interfacing to an earphone device under test through (at least) an interface 34.

In use, the earphone device under test 12 is mounted on the next vacant test station 22, through a handling process 36, after which this unit moves away to begin testing and presents the operative with another vacant station to load the next earphone device.

As illustrated in FIG. 3A, earphone devices under test 12 are in-ear earphones, which are intended to hang under their own weight on their mounting cables, placing their left and right ear units at a known height. As earphone devices 12 move on test stations 22, the test stations 22 begin their test routine (which may follow the processes outlined in in the applicant's co-pending patent applications GB 1601453.2 and GB 1604554.4). It should be noted that test stations 22 operate autonomously, yet are aware of their position on the 'conveyor' system and are networked together as described in relation to FIG. 2.

In the configuration illustrated in FIG. 3A, the earphone devices 12 are being tested whilst radiating into free air. This may represent an unnaturally low radiation load for the earphones devices under test in which case they may be fitted with test seals (e.g. sealing caps or sealing grommets) 17 intended intentionally to increase the radiation load during the test process.

As the earphone devices 12 move along the test process, they move sequentially into a localised zone 38 in which there is a carefully controlled external localised noise field 39. The noise field is generated by an array of loudspeakers, 29 and is monitored by an array of microphones 40 such that the level and spectral content (and potentially the actual pressure signal itself) associated with the external noise field 39 can be used in the measurements undertaken by the test station since this external field data is known to the test station 22 adjacent to the insonified localised zone 38. The localised noise field 39 in the insonified zone 38 may optionally be turned on and off by the test station adjacent to the speaker array 29.

When the earphone device 12 under test has reached the end of the measurement process (and the end of the 'conveyor' system) it is dismounted (e.g. by a manual or automated handling process 41), noting whether it has passed or failed the test.

Earphone device under test 12 is shown in sectional form in FIG. 3B, which illustrates the particular case of an in-earphone. One side of what would generally be a binaural pair is shown. Although an in-ear earphone is shown, this particular case contains general features representative of other types to be tested on the new invention.

Each of the two sides of the generally binaural device under test has at least one miniature loudspeaker or receiver, 13, which radiates into an acoustic space 14. In the case described above, this space may be partially bounded by the sealing cap 17 during testing. Earphone device 12 includes on each side at least one microphone 15, positioned so as to be sensitive to the pressure in space 14. Earphone device 12 includes on each side a further at least one microphone 16, positioned so as to be sensitive to the sound outside the device and substantially insensitive to the sound in the space 14.

In use, the receiver 13 is responsible for reproducing music and other program material for the end user of the device and for generating active noise cancelling signals. Microphone(s) 15 are responsible for providing the signals to implement 'feedback' active noise control, according to methods which are widely understood. Microphone(s) 16 are responsible for providing the signals to implement 'feed-forward' active noise control and 'talk-through' or 'monitoring' features, which are well-known in the art. Microphone(s) 15 may optionally further observe the progress of schemes to optimise the performance of an adaptive implementation of either feed-forward, feedback control, and to the automatic optimisation of other aspects of the electro-acoustic performance of the earphone device.

Each of the test stations 22 in the measurement system disclosed herein has access to the electrical signals associated with the receiver 13, the microphone(s) 15, and the microphone(s) 16 of the earphone device under test which is connected to it. This access is secured by the connection through interface 34.

The present invention does not prescribe any ordering for the test procedure which is imposed upon the earphone device under test. However, in one embodiment, the test system first performs measurements associated with estimation of transfer functions between the receiver drive voltage and the resulting voltage induced at the output of microphone(s) 15. These transfer functions are required to confirm the correct operation of the ordinary receiving response of the earphone device under test and of feedback active control. Such initial measurements take place notionally at the left hand end of FIG. 3A. When these initial measurements are completed, it is possible to proceed to measurements associated with estimation of transfer functions between the external microphone(s) 16 and the internal microphone(s) 15 and/or the external microphone(s) 16 and the receiver 13. These also will be referenced to the external localised noise field 39, so are made at the right hand end of FIG. 3A, in the localised zone 38.

It should be noted that the investigation of transfer functions between internal receiver 13 and the internally sensitive microphone(s) 15 require no external resources. By contrast, investigation of the relationship between the signals associated with internal transducers 13, 15 and external transducer(s) 16 requires that the earphone device under test be exposed in an orderly fashion to a precisely engineered and observed external stimulus. It is the provision of this test regime, in a fashion which is scalable to very high throughput, which is a particular feature of the present invention.

Although the earphone test assembly 20 has been presented thus far with reference to 'in-ear' earphone-type devices, it is understood to be suitable for adaptation to the testing of headphones. This is illustrated in FIG. 3C, in which the earphone device under test 12 is a headphone comprising pivotable shells 18 connected to a headband 19. The lower source impedance of the headphone (relative to the in-ear earphone in FIGS. 3A-B) may make free-air testing feasible, in which case the shells 18 of the headphone are positioned so as to ensure minimum interaction between left and right side during the test.

Figure 4:
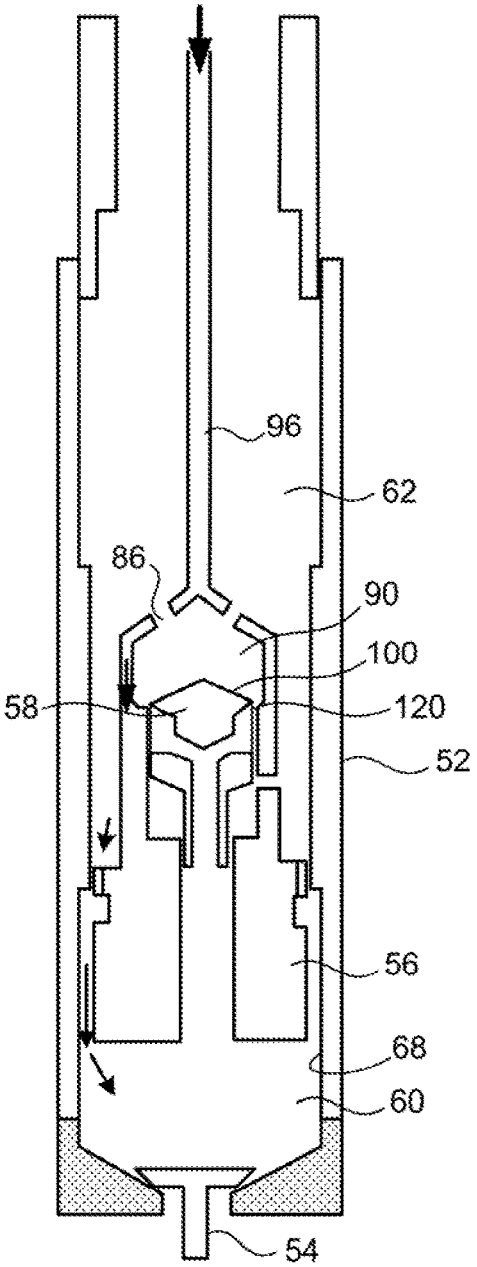
FIG. 4 is a schematic view of a second embodiment of an earphone test assembly suitable for use in the system of FIG. 2.

As illustrated in FIG. 4, if free-air testing is not feasible, test stations 22 may be fitted with a mounting fixture 50 introduced to provide the headphones under test 12 with higher radiating impedance. The shells 18 of the headphone 12 are used in the conventional orientation placed on the mounting fixture 50 as part of the mounting process. Each mounting fixture 50 may be fitted with 'artificial ear' microphones to enable the test stations to take measurements during testing.

Figure 5:
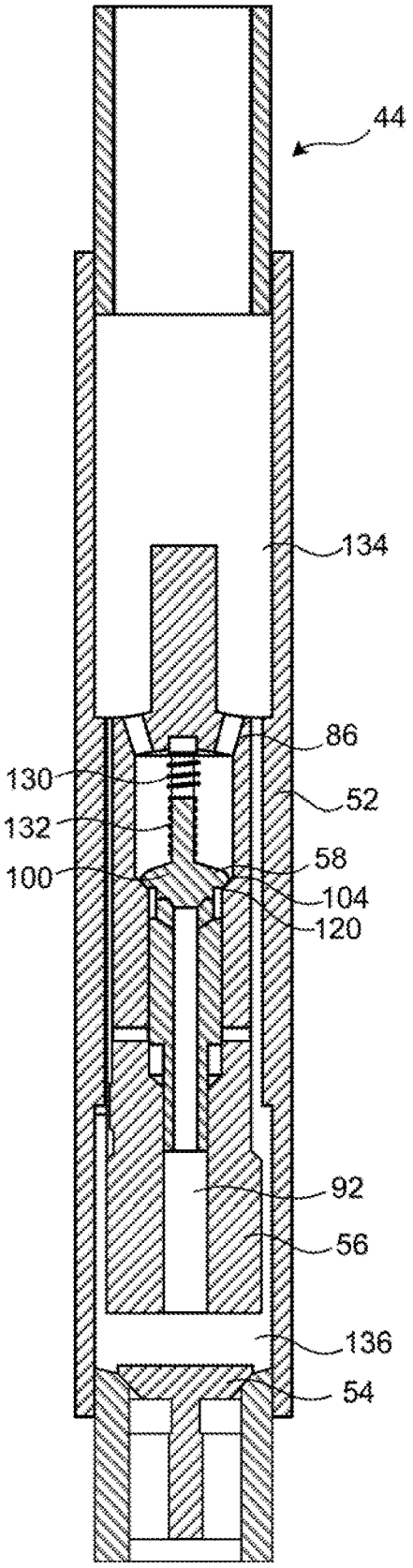
FIG. 5 is a schematic view of a third embodiment of an earphone test assembly suitable for use in the system of FIG. 2.

Similarly, as illustrated in FIG. 5, it is possible to provide test stations 22 with special mounting fixtures 52 to secure more repeatable positioning of an in-ear earphone-type device under test 12 than is possible with simply suspending the in-ear earphone devices on their own electrical cable. This may be particularly important if it is necessary to secure precise angular positioning of the earphones 12 relative to the external localised noise field 39.

As illustrated in FIG. 6A, the test stations 22 may be provided with a visual indicator 60 to provide visual indication to the operator of the result of the test. As the earphone device under test 12 approaches the end of the test process, the test result is indicated by visual indicator 60, most conveniently by the illumination of one of two differently coloured lights to signify pass or fail. This allows the operator to deal with the earphone device under test 12 in the dismount process 11 according to the result of the measurement.

Alternatively, the system may be adapted automatically to sort the units into pass/fail groups. This is illustrated in FIG. 6B, in which the electrical connections of the test stations are modified to be capable of automatic mechanical release when the test station 22 is at a specified position. The system is provided with a bin 62 to collect pass units and a separate bin 64 to collect failures. The test station 22 releases each earphone device under test 12 at the appropriate point and they fall into the correct bin.

In view of the spatially extended nature of the earphone test assembly 20, earphone devices under test can be deposited into both pass and fail bins 62, 64 at the same instant, as shown in FIG. 6C.

The use of mechanically releasing electrical connections and gravity feed into sorting bins, as described above, is appropriate to the overhead 'conveyor' embodiment of the present invention. Alternative means of sorting pass and fail devices are immediately apparent to the ordinarily skilled process engineer in the case of embodiments of this new, specialist test system using other transport systems (such as rail- or gantry-based systems, in which switch technologies may be required).

Although the description to this point has disclosed only a single area of insonification by an externally controlled noise field, it is understood that the entire path followed by the earphone devices under test 12 may be made long enough to facilitate the test as conceived by the test designer. Accordingly, as taught in FIG. 7, a test according to the present invention may include a first localised zone 38A in which known controlled external localised noise field, 39A is applied followed by a period of quiet 38C (or, at least, an area in which the earphone device under test is not disturbed by external noise conditions where—for example—calculations of adjustments are made to internal settings). This is followed by a second localised zone 38B in which a second known, controlled external localised noise field 39B is applied. The first localised noise field 39A is generated by first loudspeaker array 29A and observed by first detector array 40A and the second localised noise field 39B is generated by a second loudspeaker array 29B and observed by a second detector array 40B.

The present invention allows for any number of zones of external insonification, as required to facilitate testing to the degree of rigor required.

The transport system 30 may advance the earphone devices under test 12 at constant speed or may move in a step-wise fashion, allowing the earphone devices under test 12 to be positioned at known relative location to external fixtures (such as noise sources and drop bins) for fixed intervals.

Having described the novel features of the earphone test assembly 20 in an embodiment in which a transport system 30 is used to secure serial measurement of earphone devices moved individually past a localised zone 38 or zones 38A, 38B of external noise, an alternative approach is now illustrated in FIG. 8. In this alternative embodiment, an earphone test assembly 20' is shown in which multiple earphone devices under test are coupled to a plurality of test stations 22' arranged into a test array 80 exposed in parallel to an external noise field. As illustrated, the test stations 22' are arranged into an array which extends in two dimensions 81, 82, to secure efficiency of space. The descriptions of this embodiment of the earphone test assembly 20' all shall be made with reference to testing of headphone systems (for the sake of clarity in the drawings), in which case the test stations 22 are provided with mounting fixtures 50'. These mounting fixtures 50' may simply provide both physical mounting for the headphone 12 and a surface against which the headphone pads can seal to increase the radiation load seen by the earphone device (as has already been described). The mounting means may be repeated instances of Head and Torso Simulators ('HATS') or anything between these limits. The earphone devices under test 12 are mounted on free test stations within the array 80 for testing.

Although this embodiment of the invention has been differentiated from the earlier systems by reference to 'parallel' exposure to the external noise field, it is important to emphasise that there is no requirement for the individual test stations 22' to act synchronously. The start of the individual tests may be entirely asynchronous. The external noise field in this 'parallel' mode may also operate continuously. The earphone device under test's own passive attenuation and the averaging used in the signal processing may be used to overcome any noise contamination detrimental to measurement of internal properties of the earphone device.

It is important that each earphone device to be tested experiences the same test, independently of where it happens to be placed on the array. This casts demands on the uniformity of the external noise field, which is monitored by a number of microphones 40' distributed in the test array, as seen in FIG. 9. These microphones 40' may be used to confirm the uniformity of the external noise field as well as to report the spectral density of the external field presented at the test array. This external noise pressure spectrum will be used to confirm the sensitivity and correct operation of the externally-facing microphones 16 in the earphone devices under test.

Practical provision of the uniform external noise field is possible by a number of alternative approaches.

The first uses a distributed array of loudspeakers 29' to generate sound, which is fired at the test array, as shown in FIG. 10A. A section of the extended loudspeaker array 29' and a test array 80' are seen in plan view. It is understood that both the loudspeaker array 29' and the test array 80' are substantially planar, normal to the plane of the drawing. Given a sufficient density in the loudspeaker array 29' (which need not equal the density of the test array 80') and sufficient spacing between the planes of the two arrays, sound from the loudspeaker array 29' insonifies the test array 80' nominally as a plane wave and the desired uniformity of field can be achieved. Attention must be paid to the edges of the array (the loudspeaker array may need to be larger than the test array or some reflective surfaces should generate images). Also, reflections from behind the test array may be managed with acoustic treatments.

The second approach uses a compact source 29", as illustrated in FIG. 10B. It is understood that the source 29" approaches a point source and the test stations 22' are disposed in a test array 80" around the source 29" on the surface of a notional sphere, the centre of which is concentric with the source 29". Given a compact, omnidirectional source of acoustic source strength sufficient to generate the required pressure at the test array 80" and adequate radius of the test array 80", sound from the source 29" insonifies the test array 80 nominally as a spherical wavefront of large radius—which approaches plane wave conditions—and the desired uniformity of field can be achieved. Reflections from behind the test array 80" may be managed with acoustic treatments.

A third approach uses a similarly compact source 29'", but constrains source and test array 80'" within a reverberant enclosure 90, as illustrated in FIG. 10C. The source 29'" excites the reverberant field of the enclosure 90 allowing the test stations 22' within this space to be disposed at various distances from the source 29'" (as long as they are well outside the critical distance), simplifying the test array design and making the positioning of monitoring microphones 40' less critical. The use of the reverberant enclosure 90 has the additional benefit of increasing the diffusivity of the external noise field. In use, the operator should service each test array 80, 80', 80", 80'", mounting and dismounting the earphone devices under test 12 by approaching the test array from the opposite side from the source 29', 29", 29'", so as not to disturb the sound from the source in its passage to other earphone devices under test whose test is still under way. In the case of the test array 80''' mounted within reverberant enclosure 90, it may be possible for an operator to move between source 29''' and test array 80''' without disturbing the noise field as the test array 80''' is insonified by the reverberant field.

In both groups of embodiments of the invention, the external noise field should be substantially uniform across the test zone(s) 38, 38A, 38B, or the test array 80, 80', 80'', 80'''. This uniformity may tested in use by driving the noise field generator system by a broadband noise source and measuring sound pressure level at any two positions in the zone(s) or at any two feed-forward microphone positions in a populated test array. The accuracy of the measurement system is limited by the differences revealed between the pressures at such test positions. The sound pressure levels at these two test points should ideally not differ by more than 1.5 dB in any ⅓ octave band, between 75 Hz and 3 kHz.

Test patterns may be generated and played on the earphone device under test and input and response communicated back to the test system. The conventional observation of test pattern, and those signals at the input and output of the system-under-test, which the test pattern provokes, places a stringent instrumentation task at the heart of any successful measurement system. The present disclosure manages the impact of this instrumentation task, offering a range of implementations, from simple low-bandwidth solutions up to full, bespoke implementation.

In all cases, the time alignment between input and output data required to permit phase-synchronous transfer function estimation is preserved.

In the case of a transfer function estimation of an individual aspect of the earphone device under test, the input and response signals may be communicated back to the test system as left and right channels of a 'stereo' audio link, thereby assuring compatibility with a wide range of audio communication protocols, whilst preserving perfect time synchronisation between input and output signals. This may be performed at standard bandwidth over the audio link between the earphone device under test and test system.

If two transfer functions are to be estimated at once (i.e. left and right sides of a binaural device) then the two tests may be conducted sequentially or the bandwidth requirement over the communication link may be doubled.

Test patterns may be generated on the earphone device under test, which are made according to some deterministic rule, such that it is not necessary to communicate the test pattern back to the test system (as the 'input' signal in a transfer function estimation)—merely the response it provokes. Instead, the test system knows the deterministic rule by which the test pattern was generated on the earphone device under test and is able to recreate the same pattern, saving the time and bandwidth required to communicate it. Such rules include those governing the generation of maximum length sequences, etc. (Many other long limit-cycle automata would form suitable candidates).

Suitable test signals may be generated inside the earphone device under test using a linear-feedback shift register to generate a pseudo-random sequence (or other equivalent methods). These numerical sequences may be further conditioned before use by the application of (e.g.) filtering means to ensure an appropriate disposition of energy over frequency. Such filtering means may be applied by conventional filtering strategies, particularly those which are easily supported on the processing means available within the computational resources available on the earphone device under test. Further conditioning of the numerical sequence may be used subsequent to generation and before its use as a test pattern. Such conditioning might include processing to modify the amplitude distribution of the signal (compression or limiting etc.).

Classes of measurement in which internally-generated test patterns are important include the characterisation of receiving response of an active earphone device (i.e., the relationship between the applied audio signal and the resulting pressure developed inside the earphone device) which has onward implications for the implementation of feedback active control measures on the earphone device under test.

Transfer functions may also be estimated between signals on the earphone device under test, which are provoked by external excitation. In such cases, the input and response may be communicated back to the test system as left and right channel of a 'stereo' audio link, thereby assuring compatibility with a wide range of audio communication protocols, whilst preserving perfect time synchronisation.

An important class of such externally excited measurements are associated with characterisations of sound transmission over the earphone device under test for the purposes of understanding passive attenuation, feed-forward active noise control and 'monitoring' or 'talk-through', in which the external excitation is provided by an external sound field.

The system of the present invention comprises the following sets of functionality:

1. A means to generate an ambient noise field from a test signal.
2. A means to generate an audio input test signal.
3. A means to support the earphone device under test in a manner as to make the operation of the system repeatable and reliable in a manufacturing context.
4. A means to sense the ambient noise field within the region of the earphone device under test.
5. A means to sense the pressure within the "ear canal" modelled by the acoustic fixture in 3.
6. A means to sense the feedback microphone.
7. A means to sense the feedfoard microphone.
8. A means of controlling the earphone device under test including operational parameters and reset/power.
9. A means to estimate transfer functions calculated from the various test signals and sensed signals ("measurement").
10. A means to compare those transfer functions with a set of masks ("verification").
11. A means to (re-)configure the earphone device under test based on comparisons of transfer function estimations and test masks ("tuning") and a group of "measurement", "verification", and optional "tuning" operations forming a "test phase".
12. A means to sequence a number of "test phases" in order to be able to determine the correct manufacturing and operation of the earphone device under test ("test").
13. A means to provide a visual cue to the operator that a test has passed or failed.
14. A means of permanently storing all the "tuning" data unique to each earphone under test ("configuration").
15. A means of uniquely identifying the earphone device under test through some means of serial number or other UM.
16. A means of associating each earphone device under UUID with collected data and storing this data (data which is used fbr many purposes one of which is to facilitate the repair of failed headphones).

Additionally there are further characteristics of the present system which make it attractive in a manufacturing context:

1. Tests are performed quickly. The speed at which tests can be performed is limited by the real world acoustics. A test signal must be applied for a certain minimum length of time and the resulting signal sensed for a certain length of time—called "acoustic time". Once signals are acquired they are transformed into transfer function estimates and various comparison operations are made—called "computation time" Per station throughput is upper bounded by acoustic time.
2. Stations can be scaled while minimizing cost and being compatible with normal manufacturing structures and processes.
3. Tests are simple to operate. No skill is required beyond mounting the earphone device to the test stations. Ideally the operator mounts the earphone device to a test station, plugs it into the interface on the test station and the test starts and continues until an indicator lamp indicates a pass or fail result.

The system of the present invention scales to bring throughput to high volume levels by testing a plurality of earphone devices in parallel. Here are the steps that an operator would take in testing a quantity of earphones devices in parallel:

1. The operator mounts each earphone device ready to test.
2. An ambient noise field is generated constantly in the test space.
3. As earphone devices are mounted; testing begins approximately straight away. An indicator light indicates that the test is running.
4. Once the test is complete, the indicator light changes colour to indicate a pass or a fail condition and the operator dismounts the earphone device under test placing it in a pass or fail bin accordingly.
5. The process repeats.

1. Unlike currently deployed SSPs no bar code scan is required. This is because Flash uses a UUID within each HUT instead of requiring the operator to scan one.

2. Unlike currently deployed SSPs no error label is generated. A red indicator light at the end of the test indicates a failure. Failed HUTS are simply placed by the operator in a red bin and transferred to the repair station as they would be in instances of failure at other places on the production line. At the repair station, the engineer connects the earphone to an installation of Mission control and receives the test and repair history, the measurement data, and a root cause estimation of the headphone under repair by referencing the UUID stored in the headphone.

3. Ambient microphones close to the earphone device under test provide a reference signal for transfer calculation with ambient noise field as an input to the system being measured. This means that a single ambient noise field can be used and tests of individual earphone devices under test can start and stop at will without knowledge of the electrical signal being provided to the amplifier generating the noise field.
4. Movement of the operator around an array of earphone devices being tested either has little effect on the operation of the tests, or the movement can be choreographed in such a way as to minimize false fails, or the system can be configured such that tests only begin once the operator is out of the way.

FIG. 11A shows an example of a network infrastructure 200 for implementing the earphone test system 10 comprising a first part 200A shown in more detail in FIG. 11B and a second part 200B shown in more detail in FIG. 11C. This configuration is relevant regardless of the test methodology or physical realization in the factory.

The diagram is segmented along the horizontal into three physical areas:

1. Manufacturing Production Line
2. Network
3. Data Warehouse and Analytics Infrastructure VARIANT ONE: Manufacturing Production Line are all manufacturing sites. In the diagram below we show a single-site configuration with m test systems capable of running x, y, . . . , and z simultaneous tests. The Network is the Internet, and the Data Warehouse and Analytics Infrastructure are a set of managed services running in the Cloud. This is the likely configuration where the system operates for a number of different customers. Placing Data Warehouse and Analytics Infrastructure in the Cloud offers the following benefits at the cost of direct system control by the customer: a) prediction and estimation algorithms are able to exploit a much wider data set; b) the system can be managed by Soundchip and not necessarily relying on customer IT resources; c) reduced cost; d) the system scales according to the capabilities of the Cloud-based managed services cf. a much more limited set of capabilities available at any given customer installation.

Cases where there are concerns around data security or the integrity and reliability of Internet communications are answered by the following variant.

VARIANT TWO—The entire system runs privately on customer networks. The Network is a private Wide-Area Network (WAN) perhaps spanning multiple production sites. Data Warehouse and Analytics Infrastructure equipment is installed within the customer's private network. This scenario is a possibility for very high-volume customers wishing to take more direct ownership and control of the system.

VARIANT THREE: Variant Two plus the NTP Server shown in the diagram is replaced with a private NTP Server synchronized to GPS. This removes the need for the incoming NTP port on the Firewall to be opened. See Firewall below.

VARIANT FOUR: A hybrid is possible where the Network is a Virtual Private Network (VPN). Data Warehouse and Analytics Infrastructure continue to be Cloud-based, but customer data is separated within the Cloud using a single account for each customer. The two Firewalls (or more if the customer has multiple manufacturing sites) are connected in a secure means by using Virtual Private Network. This effectively brings the Cloud-based infrastructure into the customer's private network. This is the preferred approach to respond to customers who insist in a high level of data separation between customer data.

System Components

Firewall

This is a standard network component with the following ports opened: SSH (TCP 22). HTTP (TCP 80), HTTPS (TCP 443), NTP (UDP 123—bidirectional). The NTP port can be removed in the case of Topology Variant Three where it is replaced with a private NTP server synchronized with GPS within the trusted zone of the Network.

An example of a suitable Firewall is the Cisco ASA5512-KS ASA 5512-X (which integrates a Firewall and 6-port Router).

Router

This is a standard network component connecting each 8 bit subnet to the WAN via the Firewall.

An example of a suitable Router is the Cisco ASA5512-KS ASA 5512-X (which integrates a 6-port Router and Firewall).

Switch

This is a standard network component that creates each of the subnets present at each Manufacturing Production Line. Each subnet contains the following networked components:

up to 250 Headstands;

an Ambient Noise Field Generator;

a Monitor.

Each subnet tests one Headphone product type

Note that the Switch element shown in the diagram, may in reality be a hierarchical structure of switches and aggregate switches depending on the number of Headstands within the subnet.

An example of a suitable switch is the Cisco SF300-48PP 48-port 10/100 PoE+ Managed Switch.

Monitor

This is an optional, non-interactive component within a subnet. It provides a view into the performance of the subnet that is useful for production line managers and quality assurance staff:

a real-time status display of all test stations in the subnet including:

- the name of the product being tested within the subnet and the version of the test being run;
- status of network connection to Data Warehouse and Analytics Infrastructure; total number of tests performed by the subnet over the past 24 hours;
- trend of aggregate total first pass yield of the subnet over the past 24 hours;
- current PASS/FAIL/TESTING/MAINTENANCE status of each test station; available local result cache size of each test station;
- first pass yield trend over the past 24 hours for each test station;
- number of tests performed over the past 24 hours by each test station;
- a secure WiFi connection into the subnet that can be accessed by supervisory technical staff via SSH to provide access to each device on the subnet for purposes of configuration, commissioning, or maintenance.

No configuration of the Monitor is required as the software running on the Monitor is able to scan the subnet for other components within the Network and to calibrate the display according to the number and type of components discovered.

Implementation of Monitor consists of a standard embedded computation hardware connected to the subnet and an HELLO monitor. Software running on the unit scans the subnet for expected devices by attempting to receive a response to the HELLO API command from each possible device at 192.168.m.0-192.168.m.255 (where m is known by the Monitor since the Monitor knows its own IP address). Once each subnet device has been identified, the monitor subscribes to each device's status log (an asynchronous stream of status updates emitted by each device) by opening a standard Websocket connection to each device. (See Status Log below).

Like other networked devices within the subnet, the Monitor also implements the following software components to enable identification, configuration, monitoring, and control: a) API Server; b) Status Server; c) Log Server.

Ambient Noise Field Generator

An ambient noise field used in testing is generated by this component. Similar to a test station, the Ambient Noise Generator runs the following software components—a) API Server; b) Status Server; c) Log Server.

The properties of the noise field are stored within non-volatile memory within the device and are configured by loading a test into the device at time of deployment via the API Server. The API Server (see below for more information) also responds to HELLO API commands to enable the Monitor to identify the presence of an Ambient Noise Field Generator on the subnet.

VARIANT FIVE: Ambient Noise Field Generators scan the subnet for test stations, then subscribe to each test station status log. When there is at least one test station requesting a noise field the generator automatically starts emitting noise. The noise field is automatically deactivated when the status logs of each test station advise that no test station requires a noise field.

VARIANT SIX: As an alternative where test stations are mounted in such a way as to pass by the external noise field, the test station detects the proximity to the noise field and issues the noise field request via the status log.

Control Station

The Control Station is a native software running on Windows that provides users with:

- a Dashboard view of the production status of all products they have rights to view. (A right to view is assumed from this point in the text.);
- an ability to download raw production measurement data for their products;
- a means to sign up for email reports of status for their products (or cancel an existing subscription);
- an ability to re-configure stations for their products by updating the test. Note, that a change in the test running on a station results in an email being sent to all users signed up for a product's status reports;
- a display of all connected devices within the same 8 bit subnet of the Control Station;
- a means to automatically retrieve the test history of an earphone device connected to the computer running the software via a headstand. This is intended mostly for the repair stations at the manufacturer, but could also be used at customer service and logistics centres such as those in consumer electronics or Airline maintenance centres. All measurement results are provided and displayed with a root cause of failure estimated by statistical means;
- testing an earphone device and displaying the results.

Note that the Control Station has no direct contact with the production equipment deployed on the production line. All communication that configures, controls, and monitors production is between the Control Station and the Data Warehouse and Analytics Infrastructure via the Administrator API (see below); this simplifies and therefore strengthens security.

NTP Server

Encryption used to communicated across the untrusted zone, as well the application of a correct timestamp to test results, requires that all test stations in use maintain an accurate time. An NTP server is a standard piece of Internet infrastructure that provides this capability. A publicly available NTP Server can be replaced by a private NTP Server within the trusted zone at each Manufacturing Production Line site. One such equipment is the Meinberg LANTIME M300 https://www.meinbergglobal.com/english/products/rack-mount-1u-ntp-server.htm Result Inbox The Result Inbox is a repository of test results. Each test station's Result Uploader component (see below) moves its locally cached test result data into this repository. The repository is write only to protect against nefarious users attempting to steal information regarding the products and tests of other products.

When each test result arrives in the Result Inbox, a new On Demand Compute Service starts to process the test result (see below). Processing each test result includes:

- writing into the Result Indexer a number of different indices to enable fast retrieval of the result data;
- updating the Dashboard Store to account for the additional result data;
- placing a summary of the result data in the Administrator Outbox;
- moving the result data from the Result Inbox into a permanent location.

Administrator REST API

Control and configuration capability is exposed by the Administrator REST API. The principle client utilizing the API is Control Station although command line clients are also used primarily where batch processing or automation is required such as for administration tasks.

Each request from a client includes.

- a mandatory cryptographic signature that guarantees that both identifies the client and ensures that only the identified client issued the request;
- the action to be performed;
- any parameters required by the action.

A request received by the API gateway spawns an On Demand Compute Services (see below) to action the request and to provide a response to the client. The spawned compute service first authenticates the client making the request and second determines whether the client is allowed to perform the action with the parameters required. Valid requests are then actioned by the compute service. All requests return a synchronous response to the client. All actions are logged:

- Actions on a Headstand are indexed against the Headstand with a timestamp noting the change and which client performed the change;
- Actions on a product test are indexed against the product test with a timestamp noting the change and which client performed the change;
- Actions on a client are indexed with a timestamp noting the change and which client performed the change.

Message Outbox

Clients Users will sometimes need to receive information asynchronously. One example of this is the case where a Control Station makes a configuration update to a test station. This configuration change should appear to happen on the test station immediately. Another example is a client monitoring the status of a piece of equipment, status messages can update rapidly and this should be reflected on the monitoring client in real time.

Each client has its own message queue in the Message Outbox. System components wanting to update clients, post messages in client message queues Running clients connect to their message queues when they start and receive messages posted there in their order of posting. Messages may be posted with different timeouts depending on the message. A message that times out is removed from the queue even if the client has not received the message. Informational messages such as status information are only useful when they are consumed within a short time of posting; these messages are posted with short timeouts. Configuration information is always valid and these messages are posted without timeout.

Authentication and Authorization

Each client is assigned a universal identifier that doubles as both a means of identifying the client, as well as a cryptographic key to sign all interactions with the Data Warehouse and Analytics Infrastructure. This ensures that requests arriving from clients are genuine and untampered with.

Clients are only authorized to operate under the following conditions:

- if the operation pertains to a product test, then an authorization check is first performed to confirm that the given client is permitted to perform operations on that product. This keeps different customer activities separate.
- each client type is allowed to perform different operations. For example, Headstands are:
  - a) the only type allowed to write to the Result Inbox; (no clients are permitted to read);
  - b) not permitted to use the Administrator API; and c) permitted to read their own Message Outbox message queue (no other client is).

Dashboard Store

Results arriving from test stations in the Results Inbox spawn On Demand Compute Services to process the result data. One of the actions performed by this processing is to update the Dashboard Store. The Dashboard Store contains pre-processed summary information ready to display in a dashboard format. Clients requesting dashboard data request data directly from the Dashboard Store: no processing of result data is required as this would be prohibitively arduous in cases where millions of data sets needed to be processed in order to return the summary data.

Data are stored in a simple key-value database optimized for scalability One of the problems associated with collecting summary data in this form, when using a database of this type, is that there are no guarantees that the results arrive and/or are processed in chronological order Network and/or test station outages, as well as the highly parallel structure of the system, mean that no guarantee to the ordering of result data can be assumed. Additionally, since it is likely that multiple writes to the store are taking place at any given time there may be no dependencies between data sets and all updates to the database must be atomic. These real-time and parallel processing requirements place a restriction of the type of data that can be collected, how they are processed, and how they are stored.

The data maintained includes:

- quantity of each passing product grouped within the standard time intervals (minute, hour, day, week, month, quarter, year, forever);
- first pass yield per station, and per product over the standard time intervals, first failure distributions for each product over the standard time intervals;
- feedback plant response for each passing product average over the standard time intervals. (Note that all response data is stored in the Dashboard Store as ⅓- or ⅙-octave smoothed data to reduce storage size);
- feedforward plant response for each passing product average over the standard time intervals,
- audio response for each passing product average over the standard time intervals.

Result Store

Results arriving from test stations in the Results Inbox spawn On Demand Compute Services to process the result data. One of the actions performed by this processing is to move the result data out of the Result Inbox into a permanent storage location.

The result data is moved to the Result Store unchanged as it arrives from the originating Headstand. The result data is indexed by the Result Index (see below).

Result Index

Result data in the Result Store is indexed by this component as part of the processing initiated by new result data arriving in the Result Inbox. Indexing allows raw result data to be quickly located among multiple-millions of results. The component compiles the following indices where the first in the pair is the primary key, and the second in the pair is the secondary key and each entry points to a result in the Result Store (hyphen separation of keys denotes concatenation):

- Product-earphone device UUID number, timestamp. This allows a test history for the earphone device to be found.
- Product, timestamp. This allows an aggregated ordered list of test results to be found for a given product, or a subset of results over a time range to be returned.
- Product-Result, timestamp. This allows an aggregated ordered list of test results (limited by Result) to be found for a given product, or a subset of results over a time range to be returned.
- Product-Station, timestamp. This allows an ordered list of test results to be found for a given test station.
- Product-Station-Result, timestamp. This allows an ordered list of test results (limited by Result) to be found for a given test station Test Store Tests are defined by a set of data. Tests are stored in this component and made available to test stations for configuration.

Log Store

The system is modified by requests to the Administrator REST API. Changes to the system are logged to this component. Specifically, the following system changes are logged:

- all changes to a test station. Indexed as Headstand, Timestamp. The change is noted as is the client initiating the change.
- all changes to a Test Indexed as Test Name, Timestamp. The change is noted as is the client initiating the change.
- all changes to a client (including a test station). Indexed by Timestamp. The change is noted as in the client initiating the change.

On Demand Compute Service

An On Demand Compute Service is spawned asynchronously to execute a function in response to some defined event. The system employs On Demand Compute Services from three different event types:

1. a notification event of a new result data arriving in the Result Inbox. The compute service is started to process the result data
2. a notification event from the Administrator REST API The compute service is started to process the API request and to provide a response to the API caller.
3. a timeout notification from a periodic timer. The compute service is started to process housekeeping functions such as the issuing of status and update emails to subscribers or to age historic data to lower cost storage types.

Test Station-Earphone Device Electronic Interface

Existing solutions to connect test systems to earphone devices under test incorporate special purpose, multi-pin connectors. These connections normally entail a separate connector be employed on the PCB for the sole purpose of testing. This adds cost to the product and because product designers are looking to avoid exposing the test interface to consumers, the means to connect the earphone device under test are often clumsy and slow in a manufacturing context with operators often needing to feed ribbon cables into the earphone device.

The solution to this problem is to employ the same physical interface as used by the consumer. This reduces the material cost of the earphone device and ensures a mechanically robust solution that is fully exposed to the operator during manufacturing.

The problem however with taking this approach is that an interface for consumer electronics is not always suitable to an interface for testing. In the below we present a solution to this problem that enjoys the benefits of using the consumer interface, while maintaining a set of requirements that are unique to the testing of noise cancellation earphones.

The two connectors used by consumers in earphone applications are: a) 3.5 mm audio connector; and b) USB-C connector.

Physical Interface

VARIANT SEVEN. The earphone device under test has a USB-C connector and receives analogue audio.

The test station is connected to the earphone under test by a USB-C cable.

The test station detects that the earphone device only receives analogue audio by using the standard USB-C means as per the USB-C Specification Appendix A The test station responds by switching the SCK and SDA signals mentioned below onto the Dn1 and Dp1 lines respectively of the USB-C cable.

VARIANT EIGHT: The earphone device under test has a 3.5 mm audio connector.

The test station is connected to the earphone device by a USB-C to 3.5 mm patch cable. (test station has USB-C receptacle, earphone has 3.5 mm receptacle). The wiring of the patch cable is described in the USB-C Specification Appendix A. The test station switches SCK and SDA signals on the Dn1 and DP1 lines of the USB-C cable.

VARIANT NINE. The earphone device under test has a USB-C connector and implements a digital USB interface.

The test station is connected to the earphone under test by a USB-C cable. The test station detects by using the normal USB-C means that the earphone under test is capable of receiving an Alternative Mode specific to the purposes of testing noise cancellation earphones. The earphone device performs the standard USB-C handshake to setup the Alternative Mode and then places the SCK and SDA signals on any two of the re-assignable pins available to devices implementing an Alternative Mode.

In all three cases the protocol of communicating between the test station at the earphone device is the same. The above three variants exist only as alternative means of establishing a signalling path between the test station and various earphone devices.

Noise Cancellation Device

As described above only two signals are allocated to digitally communicate between the test station and the earphone device under test. The reason for this is simplicity in the implementation of a test solution across the variety of earphone device classes listed in the above section.

The earphone device incorporates a noise cancellation device that utilizes a standard SPI (Serial Port Interface). The SPI is a four-connector interface. In order to be able to use this interface over the two connector cable the following circuit-level changes are made:

1. Connection is only allowed between the test station and the earphone device under test; no other devices are permitted on the SPI bus.
2. Chip Select (iCS) on the noise cancellation chip is pulled low
3. Master Out Slave In (MOSI) and Master In Slave Out (MISO) on the noise cancellation chip are tied together with a series 10 kR resistor. MOSI is connected to SDA.
4. Clock (SCK) is connected to SCK.

In the case of Variant Seven or Variant Eight where the input signal to the earphone device is an analogue signal, the earphone device design has two possibilities:

1. the analogue signal is digitized by a codec on the earphone device and this digital signal is provided to the digital inputs of a digital noise cancellation device.
2. the analogue signal is input into the analogue inputs of an analogue noise cancellation device.

In both cases the Dn1 and Dp1 signals are also connected to the SCK and SDA inputs on the noise cancellation device. The noise cancellation device detects the presence of the digital test interface signals on these pins identifying them as digital signals and not analogue audio and the noise cancellation device internally disconnects its digital audio input pins. This identification takes place as either a simple initial line-level detection, the recognition of a burst of known digital signalling on these lines, or a combination of both.

Additionally, the noise cancellation device incorporates the means to generate digital FIR filtered pseudo random stimulus signal that can be configured via the same means that other aspects of the device are configured such as the reading and writing to registers within the device. Configuration parameters for each stimulus signal allow:

1. the FIR filter to be controlled;
2. identify the point in the noise cancellation signal path where the stimulus signal is to be applied (audio inputs, feedback microphone inputs, or feedforward microphone inputs.)

Protocol

The above physical interface is sufficient for the two-way communication between the test station and the earphone device under test because 1. the following communication protocol defines when the test station sends and the earphone device receives and vis a versa and ensures that only one party is sending while the other party is receiving.
2. stimulus signals are not required to be sent by the test station to the earphone under test and instead are generated and consumed as required by the test.

FIG. 12 illustrates an example of how the communication between test station and earphone device might take place. Actual tests will use multiple applications of these messages:

Each message is a byte stream of the following fields:

Command: a string of two bytes indicating the command being sent;

Length: a string of four bytes indicating the length of the payload field;

Payload: a string of zero or more bytes containing the data required for the Command;

Checksum: a four-byte CRC32 checksum of the concatenation of Command. Length, and Payload;

Note that during a test the earphone device must in this example be capable of writing a minimum of $3f_s$ 16-bit samples per second (minimum), $6f_s$ 16-bit samples per second (reduced test time) assuming a worst case receiving response measurement requiring three signals per channel plus overhead. "Overhead" is a one byte identifier placed ahead of each sample to indicate the source of the sample.

We claim:

1. An earphone test system comprising:

a plurality of test stations each operative to perform a function during testing of an earphone device coupled thereto;

wherein during testing of earphone devices coupled to the plurality of test stations the earphone test system is operative to expose each of the plurality of test stations to a noise field generated by a common noise field source;

wherein the common noise field source is a localised noise field source configured to provide a localised noise field, and wherein the plurality of test stations are arranged in a test array to allow exposure of the plurality of test stations to the localised noise field in parallel.

2. An earphone test system according to claim 1, wherein the earphone devices comprise at least one electroacoustic driver and a processor module.

3. An earphone test system according to claim 2, wherein each earphone device comprises at least one microphone and the processor module comprises an audio processing component is operative to process signals received from the at least one microphone.

4. An earphone test system according to claim 1, wherein the test array is disposed on the surface of a notional sphere concentric with the localised noise field source.

5. An earphone test system according to claim 1, wherein the noise field generated by the noise field source during operation of the earphone test system is continuously generated.

6. An earphone test system according to claim 1, wherein the noise field source is activated/deactivated in dependent upon a test status of the plurality of test stations or position of the plurality of test stations.

7. An earphone test system according to claim 1, wherein testing of the earphone devices involves a test routine comprises electrical and/or electro-acoustic testing.

8. An earphone test system according to claim 7, wherein the test routine further comprises configuring the earphone device based on the results of the test routine.

9. An earphone test system according to claim 1, wherein each of the plurality of test stations is configured to signal test results to a system operator.

10. An earphone test system according to claim 1, wherein the test system is operative to automatically sort tested earphone devices into pass/reject categories.

11. An earphone test system according to claim 10, wherein the test stations comprise an automatic release mechanism to allow tested earphone devices sorted into pass/reject categories to be released into an appropriate collection region.

12. An earphone test system according to claim 1, wherein each of the plurality of test stations is configured to allow mounting of earphone devices thereto by suspending the earphone devices from an electrical connection.

13. An earphone test system according to claim 1, wherein the plurality of test stations each comprise an orientating frame for mounting an earphone device to the test station in a predetermined orientation.

14. An earphone test system according to claim 1, wherein the plurality of test stations is configured to test earphone devices radiating into free-space.

15. An earphone test system according to claim 1, wherein the plurality of test stations is configured to test earphone devices whilst fitted with a test seal configured to present a high radiation load during a test routine.

16. An earphone test system according to claim 1, wherein the plurality of test stations each comprise a mounting fixture provided both to mount headphones and to provide a mating surface configured to provide a high radiation load during a test routine.

17. An earphone test system according to claim 16, wherein the mounting fixture includes:

an ear simulator part defining a passageway leading to an external opening; and an eardrum microphone mounted in the passageway of the ear simulator part.

18. An earphone test system according to claim 1, wherein the earphone test system further comprises at least one monitoring microphone operative to measure the noise field generated by the noise field source.

19. An earphone test system according to claim 18, wherein the at least one microphone provides observations for a system designated to control or regulate the external noise.

20. An earphone test system according to claim 1, wherein one of each test station/earphone device pairing includes a test module for performing automated testing of the earphone device when mounted on/connected to the test station.

21. An earphone test system according to claim 20, wherein each test module is configured to measure a response of the earphone device to a test pattern reproduced by the noise field source or by an electro-acoustic driver of the earphone device.

22. An earphone test system according to claim 20, wherein each test module is configured to perform one or more of the following analyses:

a receiver response check;

a receiver polarity check;

a plant response check;

a plant phase check;

a plant fitting check;

a gain adjust limit check;

a feedback ANR check;

an EQ response check; and/or a balance test.

23. An earphone test system according to claim 20, wherein each test module is provided as part of the test station and the earphone devices to be tested each comprise a test pattern generator configured to generate one or more pre-generated test pattern operative to produce an input signal to drive the electroacoustic driver of the earphone device.

24. An earphone test system according to claim 23, wherein the test pattern generator operates according to a deterministic rule known to each test station.

25. An earphone test system according to claim 1, wherein each test module is connected to a computer network.

26. An earphone test system according to claim 25, wherein each test module is configured to follow a test routine defined on a separate test routine source component of the computer network.

27. An earphone test system according to claim 25, wherein the earphone test system is configured to accumulate test results in a central location.

28. An earphone test system according to claim 25, wherein the earphone test system further comprises a link to at least one further test module operative to test components or sub-systems from which the earphone devices are assembled.

29. An earphone test system according to claim 28, wherein the earphone test system comprises a link to at least one component-level test module for testing components used to assemble the earphone devices or a link to at least one sub-assembly test module for testing sub-assembly parts used to assemble the earphone devices.

30. A method of testing earphone devices during a production line manufacturing process comprising:

providing an earphone test system as defined in claim 1;

for a first group of earphone devices to be tested:

1) coupling the earphone devices with available ones of the plurality of test stations;

2) exposing the plurality of test stations to the noise field generated by the common noise field source;

3) for each earphone device activating a test routine for testing the earphone device such that at least a phase of the test routine is conducted whilst the test station to which the earphone device is coupled is exposed to the noise field;

4) de-coupling each earphone device from its respective one of the plurality of test stations following completion of at least the phase of the test routine on the earphone device; and repeating steps 1)-4) for a second group of earphone devices to be tested.

31. A method according to claim 30, wherein the step of coupling the second group of earphone devices to the plurality of test stations is commenced before the step of de-coupling the first group of earphone devices from the plurality of test stations is completed.

32. A method according to claim 30, wherein the step of activating a test routine is carried out independently for each earphone device.

33. An earphone test system comprising:

a plurality of test stations each operative to perform a function during testing of an earphone device coupled thereto;

wherein during testing of earphone devices coupled to the plurality of test stations the earphone test system is operative to expose each of the plurality of test stations to a noise field generated by a common noise field source;

wherein the common noise field source is configured to provide a localised noise field in a localised zone of the earphone test system, and wherein the earphone test system further comprises a transport mechanism for moving the plurality of test stations relative to the localised zone such that the plurality of test stations are exposed sequentially to the localised noise field.

34. An earphone test system according to claim 33, wherein the localised zone comprises a first region in which a first phase of a test routine is performed and a second region provided in series with the first region and in which a second phase of a test routine is performed.

35. An earphone test system comprising:

a plurality of test stations each operative to perform a function during testing of an earphone device coupled thereto;

wherein during testing of earphone devices coupled to the plurality of test stations the earphone test system is operative to expose each of the plurality of test stations to a noise field generated by a common noise field source;

wherein the noise field generated by the common noise field source is a dispersed uniform noise field, and wherein the plurality of test stations are arranged in a test array to allow exposure of the plurality of test stations to the noise field in parallel.

36. An earphone test system according to claim 35, wherein the common noise field source comprises a distributed array of electro-acoustic drivers operative to generate a dispersed uniform noise field.

37. An earphone test system according to claim 36, wherein the distributed array of electro-acoustic drivers and the test array are substantially planer and disposed substantially parallel to each other.

38. An earphone test system according to claim 35, wherein an acoustic treatment is disposed behind the test array to minimise reflections which might reduce uniformity of pressure in the dispersed uniform noise field generated at the test array.

39. An earphone test system according to claim 35, wherein the dispersed uniform noise field is generated by housing the common noise field source and the plurality of test stations within a reverberant enclosure.

40. A method of testing earphone devices during a production line manufacturing process comprising:

providing an earphone test system as defined in claim 33;

for a first group of earphone devices to be tested:

1) coupling the earphone devices with available ones of the plurality of test stations;

2) exposing the plurality of test stations to the noise field generated by the common noise field source;

3) for each earphone device activating a test routine for testing the earphone device such that at least a phase of the test routine is conducted whilst the test station to which the earphone device is coupled is exposed to the noise field;

4) de-coupling each earphone device from its respective one of the plurality of test stations following completion of at least the phase of the test routine on the earphone device; and repeating steps 1)-4) for a second group of earphone devices to be tested.

41. A method of testing earphone devices during a production line manufacturing process comprising:

providing an earphone test system as defined in claim 35;

for a first group of earphone devices to be tested:

1) coupling the earphone devices with available ones of the plurality of test stations;

2) exposing the plurality of test stations to the noise field generated by the common noise field source;

3) for each earphone device activating a test routine for testing the earphone device such that at least a phase of the test routine is conducted whilst the test station to which the earphone device is coupled is exposed to the noise field;

4) de-coupling each earphone device from its respective one of the plurality of test stations following completion of at least the phase of the test routine on the earphone device; and repeating steps 1)-4) for a second group of earphone devices to be tested.

* * * * *